US006715990B1

(12) United States Patent
Arness et al.

(10) Patent No.: US 6,715,990 B1
(45) Date of Patent: Apr. 6, 2004

(54) FIRST STAGE TURBINE BUCKET AIRFOIL

(75) Inventors: Brian Peter Arness, Simpsonville, SC (US); Eduardo Enrique Paz, Albany, NY (US); Jacob Charles Perry, II, Taylors, SC (US); Gunnar Leif Siden, Greenville, SC (US); Andrew Jones, Jr., Greenville, SC (US); Lawrence Paul Timko, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/246,689

(22) Filed: Sep. 19, 2002

(51) Int. Cl.[7] ..... F01D 5/14

(52) U.S. Cl. ..... 416/223 A; 416/DIG. 2

(58) Field of Search ..... 416/243, DIG. 2, 416/223 A, DIG. 5

(56) References Cited

U.S. PATENT DOCUMENTS 6,503,059 B1 * 1/2003 Frost et al. ..... 416/223 A
6,558,122 B1 * 5/2003 Xu et al. ..... 416/223 A

* cited by examiner

*Primary Examiner*—Edward K. Look
*Assistant Examiner*—Kimya N McCoy
(74) *Attorney, Agent, or Firm*—Nixon & Vanderhye

(57) ABSTRACT

The first stage buckets have airfoil profiles substantially in accordance with Cartesian coordinate values of X, Y and Z set forth Table I wherein X and Y values are in inches and the Z value is non-dimensional along the bucket centerline coincident with a turbine radius and convertible to a Z distance in inches from the turbine axis by multiplying the Z value by the height of the airfoil and adding the root radius to the result. The X and Y distances may be scalable as a function of the same constant or number to provide a scaled up or scaled down airfoil section for the bucket. The nominal airfoil given by the X, Y and Z distances lies within an envelop of ±0.160 inches.

15 Claims, 5 Drawing Sheets

FIRST STAGE TURBINE BUCKET AIRFOIL

BACKGROUND OF THE INVENTION

The present invention relates to a turbine bucket for a gas turbine stage and particularly relates to a first stage turbine bucket airfoil profile.

In recent years, advanced gas turbines have trended toward increasing firing temperatures in order to meet system requirements of efficiency and loading. Consequently, efforts have been made to improve the cooling of the various turbine stages. It will also be appreciated that the design and construction of turbine buckets and in particular, air-cooled buckets for a first turbine stage, require optimized aerodynamic efficiency as well as optimized aerodynamic and mechanical bucket loading.

BRIEF DESCRIPTION OF THE INVENTION

In accordance with a preferred embodiment of the present invention, there is provided a unique turbine bucket airfoil profile for the buckets of a turbine stage, preferably the first stage of a gas turbine. The bucket airfoil profile is defined by a unique loci of points to achieve the necessary efficiency and loading requirements whereby improved turbine performance is obtained. These unique loci of points define the nominal airfoil profile and are identified by the X, Y and Z Cartesian coordinates of Table I which follows. The 3600 points for the coordinate values shown in Table I are for a cold, i.e., room temperature profile at various cross-sections of the bucket airfoil along its length. The X and Y coordinates are given in distance dimensions, e.g., units of inches, and are joined smoothly at each Z location to form a smooth continuous airfoil cross-section. The Z coordinates are given in non-dimensionalized form from 0 to 1 along a bucket centerline coincident with a radius from the axis of rotation. By multiplying the airfoil height dimension, e.g., in inches, by the non-dimensional Z value of Table I and adding that value to the root radius of the bucket, the actual Z distance from the rotational axis, e.g., in inches, is obtained. Each defined cross-section is joined smoothly with adjacent cross-sections to form the complete airfoil shape.

It will be appreciated that as each bucket airfoil heats up in use, the profile will change as a result of stress and temperature. Thus, the cold or room temperature profile is given by the X, Y and Z coordinates for manufacturing purposes. Because a manufactured bucket airfoil profile may be different from the nominal airfoil profile given by the following table, a distance of plus or minus 0.160 inches from the nominal profile in a direction normal to any surface location along the nominal profile and which includes any coating process, defines the profile envelope for this bucket airfoil. The design is robust to this variation without impairment of the mechanical and aerodynamic functions.

It will also be appreciated that the airfoil can be scaled up or scaled down geometrically for introduction into similar turbine designs. Consequently, the X and Y coordinates in inches and the Z coordinates, when converted to inches, of the nominal airfoil profile given below are a function of the same constant or number. That is, the X, Y and Z coordinate values in inches may be multiplied or divided by the same constant or number to provide a scaled up or scaled down version of the bucket airfoil profile while retaining the airfoil section shape.

In a preferred embodiment according to the present invention, there is provided a turbine bucket having a bucket airfoil shape in an envelope within ±0.160 inches in a direction normal to any airfoil surface location wherein the airfoil has a nominal profile substantially in accordance with Cartesian coordinate values of X, Y and Z set forth in Table I wherein Z is a non-dimensional value along a bucket centerline coincident with a radius from a turbine axis of rotation convertible to a Z distance in inches from said turbine axis by multiplying the Z value by a height of the airfoil and adding that product to a root radius of the bucket and wherein X and Y are distances in inches defining the airfoil profile at each distance Z, the profiles at the Z distances being joined smoothly with one another to form a complete airfoil shape.

In a further preferred embodiment according to the present invention, there is provided a turbine bucket having an uncoated nominal airfoil profile substantially in accordance with Cartesian coordinate values of X, Y and Z set forth in Table I wherein Z is a non-dimensional value along a bucket centerline coincident with a radius from a turbine axis of rotation convertible to a Z distance in inches from said turbine axis by multiplying the Z value by a height of the airfoil and adding that product to a root radius of the bucket and wherein X and Y are distances in inches defining the airfoil profile at each distance Z, the profiles at the Z distances being joined smoothly with one another to form a complete airfoil shape, the X and Y distances being scalable as a function of the same constant or number to provide a scaled-up or scaled-down bucket airfoil.

In a further preferred embodiment according to the present invention, there is provided a turbine comprising a turbine wheel having a plurality of buckets, each of said buckets having an airfoil shape in an envelope within ±0.160 inches in a direction normal to any airfoil surface location wherein the airfoil has a nominal profile substantially in accordance with Cartesian coordinate values of X, Y and Z set forth in Table I wherein Z is a non-dimensional value along a bucket centerline coincident with a radius from a turbine axis of rotation convertible to a Z distance in inches from said turbine axis by multiplying the Z value by a height of the airfoil and adding that product to a root radius of the bucket and wherein X and Y are distances in inches defining the airfoil profile at each distance Z, the profiles at the Z distances being joined smoothly with one another to form a complete airfoil shape.

In a further preferred embodiment according to the present invention, there is provided a turbine comprising a turbine wheel having a plurality of buckets, each of said buckets having an uncoated nominal airfoil profile substantially in accordance with Cartesian coordinate values of X, Y and Z set forth in Table I wherein Z is a non-dimensional value along a bucket centerline coincident with a radius from a turbine axis of rotation convertible to a Z distance in inches from said turbine axis of rotation by multiplying the Z value by a height of the airfoil and adding that product to a root radius of the bucket and wherein X and Y are distances in inches defining the airfoil profile at each distance Z, the profiles at the Z distances being joined smoothly with one another to form a complete airfoil shape, the X and Y distances being scalable as a function of the same constant or number to provide a scaled-up or scaled-down bucket airfoil.

DETAILED DESCRIPTION OF THE INVENTION

Figure 1:
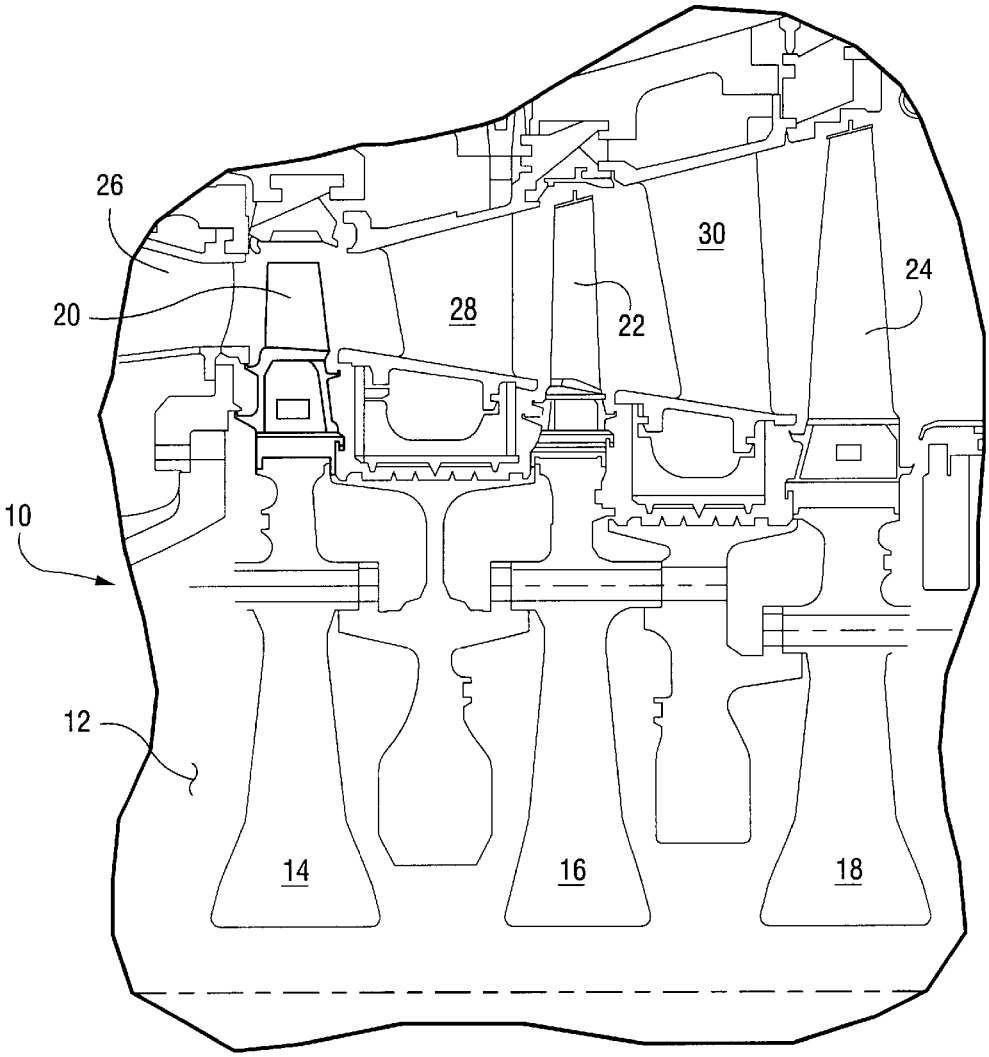
FIG. 1 is a schematic illustration of a turbine having a first stage turbine wheel employing the buckets and bucket airfoils hereof.

Referring now to FIG. 1, there is illustrated a portion of a turbine generally designated 10 in which a first stage turbine bucket 20 having an airfoil profile as defined herein may be utilized. Turbine 10 includes a rotor 12 having first, second and third stage rotor wheels 14, 16 and 18 having buckets 20, 22 and 24 in conjunction with the respective stator vanes 26, 28 and 30 of the various stages of the rotor. It will be appreciated that a three stage turbine is illustrated.

The first stage comprises the rotor wheel 14 on which buckets 20 are mounted in axial opposition to the upstream stator vanes 26. It will be appreciated that a plurality of the buckets 20 are spaced circumferentially one from the other about the first stage wheel 14 and in this instance there are ninety-two buckets mounted on the first stage wheel 14.

Figure 2:
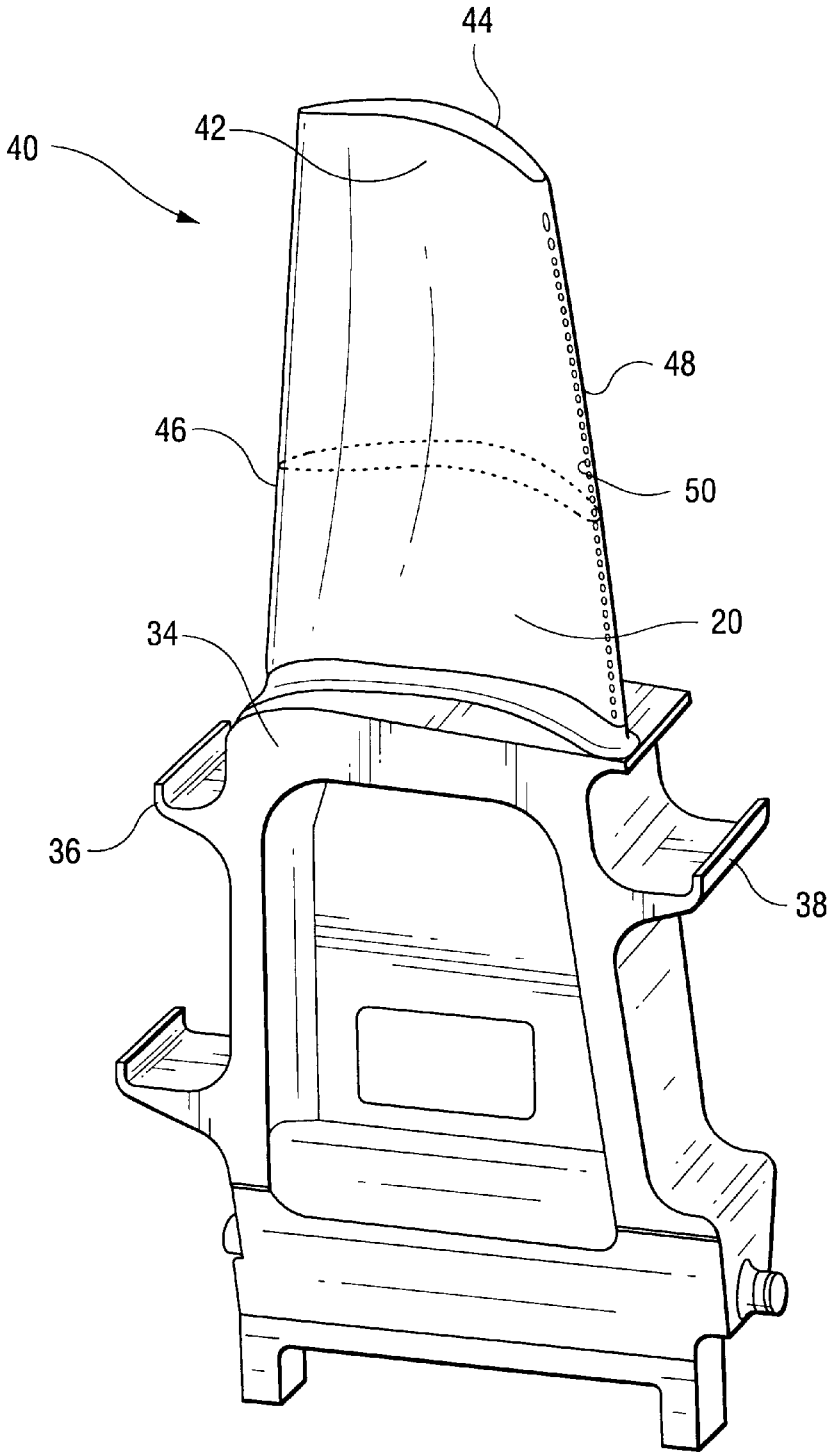
FIG. 2 is a top, trailing edge and pressure side perspective view of a first stage turbine bucket including an airfoil and a shank in accordance with a preferred embodiment of the present invention.
Figure 3:
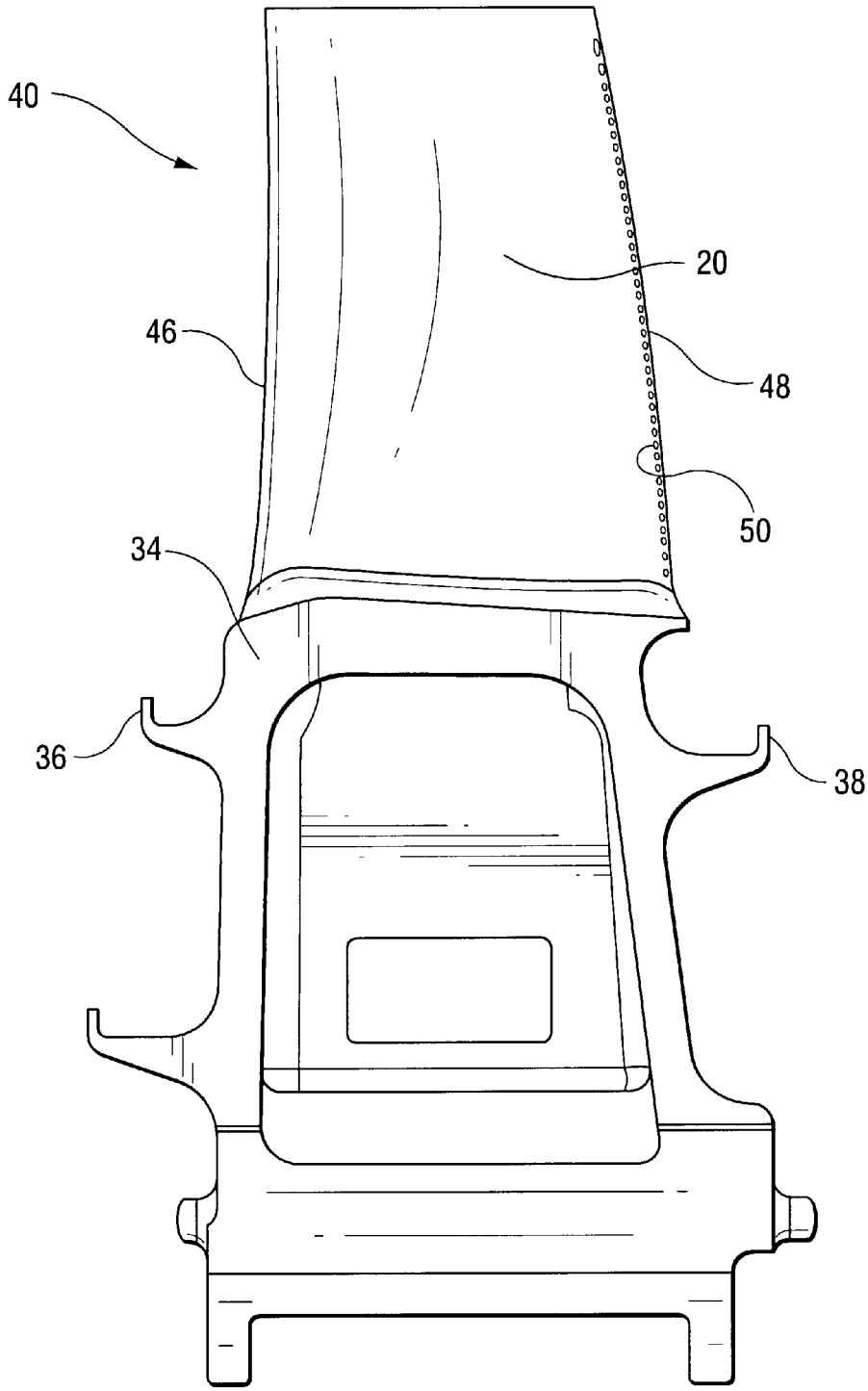
FIG. 3 is a side elevational view of the bucket including the airfoil hereof.
Figure 4:
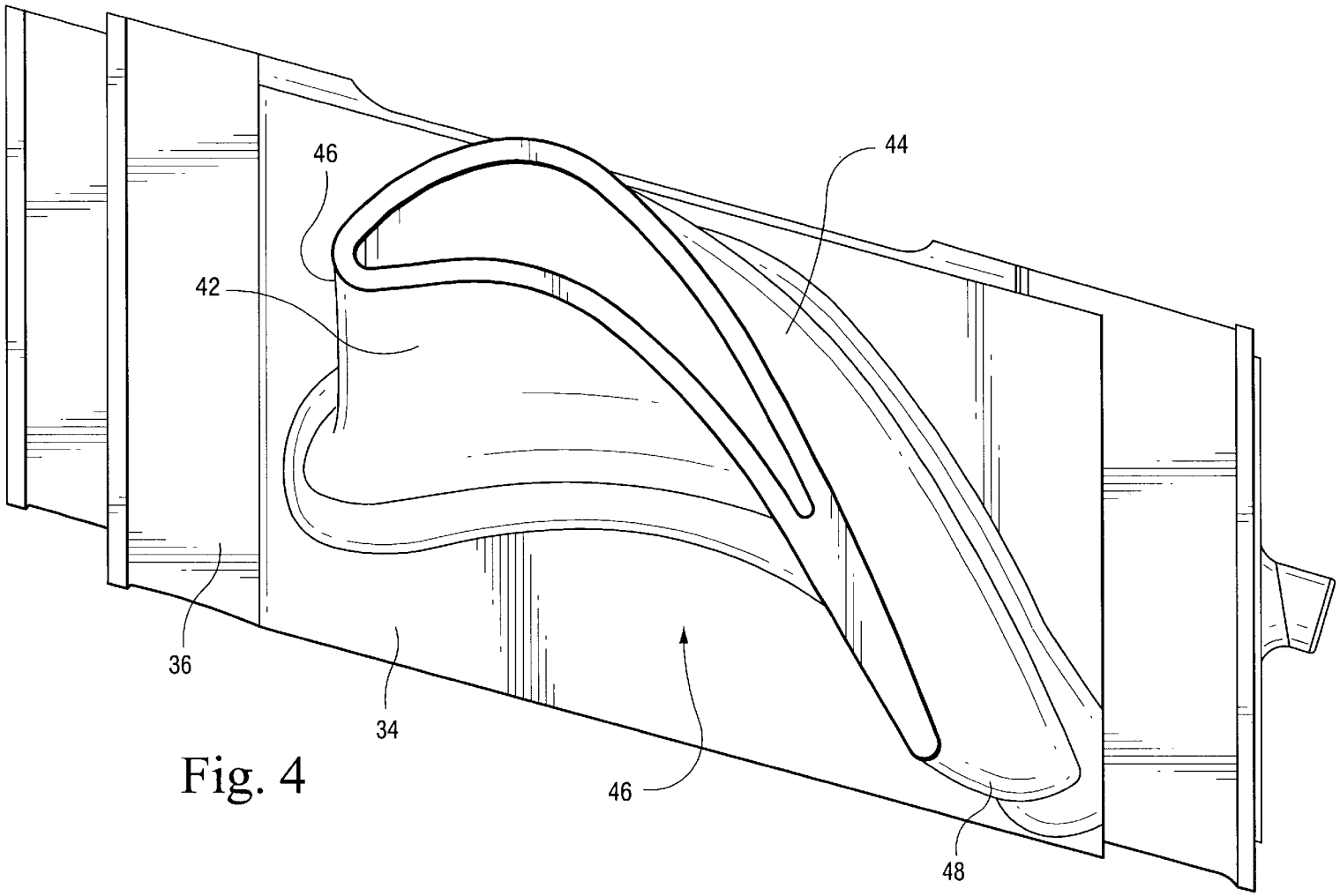
FIG. 4 is a top plan view thereof.
Figure 5:
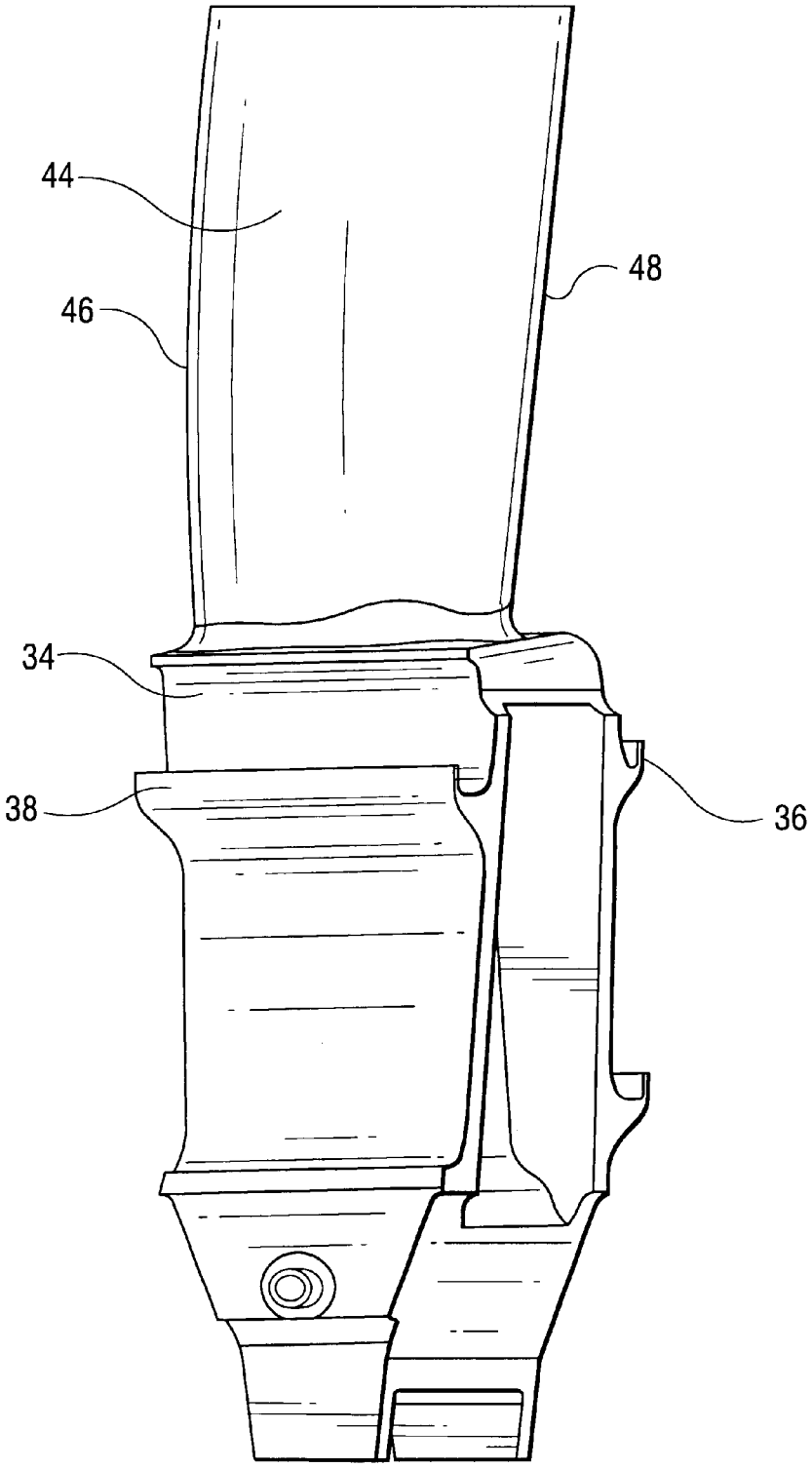
FIG. 5 is a rear suction side perspective view of the bucket airfoil hereof.

Referring now to FIG. 2, there is illustrated a turbine bucket constructed in accordance with the present invention including an airfoil 40 mounted on a platform 34. The turbine bucket also includes forward and aft wheel space seals, i.e, angel wings 36 and 38, respectively. The buckets 20 are suitably mounted on the turbine wheel 14 by means, not shown. The airfoil 40 and platform 34 are collectively referred to as a bucket 20. The airfoil 40 has a profile including a compound curvature with suction and pressure sides 42 and 44, respectively, as well as a leading edge 46 and trailing edge 48. This first stage bucket 20 is preferably air cooled and includes a series of internal passages, not shown, for flowing cooling air to cool the airfoil 40, the cooling air exiting into the hot gas path of the turbine through apertures 50 along the trailing edge 48.

A Cartesian coordinate system of X, Y and Z values given in Table I defines the profile of airfoil 40. The coordinate values for the X and Y coordinates are set forth in inches in Table I although other units of dimensions may be used. The Z values are set forth in Table I in non-dimensional form from 0 to 1 along a bucket centerline coincident with a radius from the axis of rotation. To convert the Z value to a Z coordinate value, e.g., in inches, from the turbine axis of rotation, the non-dimensional Z value given in the table is multiplied by the height of airfoil 40 in inches and that product is added to the root radius in inches. The airfoil height is measured from the intersection of the bucket centerline, which is along a radius from the centerline or axis of the turbine, and the root radius of the flowpath. The z coordinate value of this intersection with the root radius for each bucket of the first stage in a preferred embodiment is 49.400 inches. The height of the first stage airfoil bucket from the root radius in this preferred embodiment is 6.815 inches. The Cartesian coordinate system has orthogonally-related X, Y and Z axes with the Z axis extending perpendicular to a plane normal to a plane containing the X and Y values. When converted to inches, the Z distance commences at 0 at the turbine centerline. The Y axis lies parallel to the turbine rotor centerline, i.e., the rotary axis.

By defining X and Y coordinate values at selected locations in a Z direction normal to the X, Y plane, the profile of airfoil 40 can be ascertained. By connecting the X and Y values with smooth continuing arcs, each profile section at each distance Z is fixed. The surface profiles of the various surface locations between the distances Z are determined by smoothly connecting the adjacent cross-sections to one another to form the airfoil. These values represent the airfoil profiles at ambient, non-operating or non-hot conditions and are for an uncoated airfoil. The sign convention assigns a positive value to Z values and positive and negative values for the X and Y coordinates as typically used in Cartesian coordinate systems.

The Table I values are generated and shown to three decimal places for determining the profile of the airfoil. There are typical manufacturing tolerances as well as coatings which must be accounted for in the actual profile of the airfoil. Accordingly, the values for the profile given in Table I are for a nominal airfoil. It will therefore be appreciated that ± typical manufacturing tolerances, i.e., ± values, including any coating thicknesses, are additive to the X and Y values given in Table I below. Accordingly, a distance of ±0.160 inches in a direction normal to any surface location along the airfoil profile defines an airfoil profile envelope for this particular bucket airfoil design and turbine.

The coordinate values given in Table I below provide the preferred nominal profile envelope.

TABLE I

| X | Y | Z' | X | Y | Z' | X | Y | Z' |
|---|---|---|---|---|---|---|---|---|
| −2.106 | −0.412 | 0.000 | −1.959 | −0.414 | 0.034 | −2.296 | −0.358 | 0.069 |
| −2.243 | −0.394 | 0.000 | −2.217 | −0.399 | 0.034 | −2.381 | −0.208 | 0.069 |
| −2.398 | −0.307 | 0.000 | −2.370 | −0.309 | 0.034 | −2.340 | −0.001 | 0.069 |
| −2.432 | −0.136 | 0.000 | −2.405 | −0.137 | 0.034 | −2.156 | 0.301 | 0.069 |
| −2.328 | 0.101 | 0.000 | −2.306 | 0.104 | 0.034 | −2.120 | −0.415 | 0.069 |
| −2.048 | 0.437 | 0.000 | −2.035 | 0.448 | 0.034 | −2.375 | −0.243 | 0.069 |
| −2.046 | −0.413 | 0.000 | −1.848 | −0.403 | 0.034 | −2.361 | −0.060 | 0.069 |
| −2.205 | −0.402 | 0.000 | −2.179 | −0.407 | 0.034 | −2.218 | 0.216 | 0.069 |
| −2.374 | −0.333 | 0.000 | −2.347 | −0.335 | 0.034 | −1.877 | 0.614 | 0.069 |
| −2.436 | −0.173 | 0.000 | −2.408 | −0.174 | 0.034 | −2.060 | −0.419 | 0.069 |
| −2.360 | 0.048 | 0.000 | −2.336 | 0.049 | 0.034 | −2.265 | −0.376 | 0.069 |
| −2.120 | 0.362 | 0.000 | −2.105 | 0.370 | 0.034 | −2.364 | −0.277 | 0.069 |
| −1.817 | 0.651 | 0.000 | −2.141 | −0.412 | 0.034 | −2.372 | −0.096 | 0.069 |
| −1.985 | −0.412 | 0.000 | −2.319 | −0.357 | 0.034 | −2.252 | 0.164 | 0.069 |
| −2.167 | −0.407 | 0.000 | −2.408 | −0.210 | 0.034 | −1.950 | 0.539 | 0.069 |
| −2.346 | −0.354 | 0.000 | −2.364 | −0.007 | 0.034 | −1.999 | −0.418 | 0.069 |
| −2.436 | −0.209 | 0.000 | −2.173 | 0.290 | 0.034 | −2.231 | −0.391 | 0.069 |
| −2.388 | −0.008 | 0.000 | −2.081 | −0.416 | 0.034 | −2.346 | −0.308 | 0.069 |

TABLE I-continued

| X | Y | Z' | X | Y | Z' | X | Y | Z' |
|---|---|---|---|---|---|---|---|---|
| −2.190 | 0.284 | 0.000 | −2.287 | −0.375 | 0.034 | −2.379 | −0.133 | 0.069 |
| −1.854 | −0.403 | 0.000 | −2.401 | −0.246 | 0.034 | −2.284 | 0.110 | 0.069 |
| −2.314 | −0.371 | 0.000 | −2.386 | −0.064 | 0.034 | −2.021 | 0.462 | 0.069 |
| −2.430 | −0.244 | 0.000 | −2.237 | 0.208 | 0.034 | −1.939 | −0.414 | 0.069 |
| −2.412 | −0.064 | 0.000 | −1.887 | 0.597 | 0.034 | −2.195 | −0.402 | 0.069 |
| −2.256 | 0.203 | 0.000 | −2.020 | −0.416 | 0.034 | −2.323 | −0.335 | 0.069 |
| −1.896 | 0.582 | 0.000 | −2.253 | −0.389 | 0.034 | −2.382 | −0.171 | 0.069 |
| −2.279 | −0.384 | 0.000 | −2.389 | −0.279 | 0.034 | −2.313 | 0.055 | 0.069 |
| −2.417 | −0.277 | 0.000 | −2.397 | −0.100 | 0.034 | −2.090 | 0.383 | 0.069 |
| −2.424 | −0.100 | 0.000 | −2.273 | 0.156 | 0.034 | −1.827 | −0.401 | 0.069 |
| −2.293 | 0.153 | 0.000 | −1.962 | 0.524 | 0.034 | −2.158 | −0.410 | 0.069 |
| −1.973 | 0.511 | 0.000 | −1.596 | 0.842 | 0.034 | −1.801 | 0.687 | 0.069 |
| −1.590 | −0.375 | 0.000 | −1.284 | −0.323 | 0.034 | −1.364 | 1.021 | 0.069 |
| −1.711 | 0.739 | 0.000 | −1.369 | 0.995 | 0.034 | −1.715 | −0.383 | 0.069 |
| −1.457 | −0.361 | 0.000 | −1.735 | −0.389 | 0.034 | −1.456 | 0.962 | 0.069 |
| −1.325 | −0.348 | 0.000 | −1.267 | 1.052 | 0.034 | −1.604 | −0.362 | 0.069 |
| −1.372 | 0.971 | 0.000 | −1.623 | −0.372 | 0.034 | −1.546 | 0.898 | 0.069 |
| −1.192 | −0.337 | 0.000 | −1.484 | 0.921 | 0.034 | −1.491 | −0.340 | 0.069 |
| −1.489 | 0.899 | 0.000 | −1.510 | −0.355 | 0.034 | −1.634 | 0.831 | 0.069 |
| −1.722 | −0.390 | 0.000 | −1.809 | 0.667 | 0.034 | −1.188 | 1.118 | 0.069 |
| −1.601 | 0.821 | 0.000 | −1.704 | 0.757 | 0.034 | −1.379 | −0.319 | 0.069 |
| −1.167 | 1.078 | 0.000 | −1.397 | −0.338 | 0.034 | −1.718 | 0.761 | 0.069 |
| −0.877 | −0.319 | 0.000 | −0.280 | 1.286 | 0.034 | −1.266 | −0.298 | 0.069 |
| −0.076 | 1.238 | 0.000 | −0.542 | −0.269 | 0.034 | −0.399 | −0.224 | 0.069 |
| 0.059 | −0.382 | 0.000 | −1.163 | 1.104 | 0.034 | −0.439 | 1.314 | 0.069 |
| −0.720 | −0.316 | 0.000 | −0.946 | 1.192 | 0.034 | −1.153 | −0.279 | 0.069 |
| −0.724 | 1.227 | 0.000 | −0.416 | −0.273 | 0.034 | −1.004 | 1.199 | 0.069 |
| −0.563 | −0.317 | 0.000 | −1.170 | −0.308 | 0.034 | −0.273 | −0.231 | 0.069 |
| −0.284 | 1.263 | 0.000 | −0.500 | 1.285 | 0.034 | −0.997 | −0.256 | 0.069 |
| −0.407 | −0.324 | 0.000 | −0.291 | −0.281 | 0.034 | −0.065 | 1.280 | 0.069 |
| −0.950 | 1.165 | 0.000 | −1.014 | −0.292 | 0.034 | −0.147 | −0.244 | 0.069 |
| −0.251 | −0.336 | 0.000 | −0.072 | 1.259 | 0.034 | −0.622 | 1.299 | 0.069 |
| −1.034 | −0.327 | 0.000 | −0.166 | −0.293 | 0.034 | −0.841 | −0.239 | 0.069 |
| −0.505 | 1.259 | 0.000 | −0.857 | −0.279 | 0.034 | −0.023 | −0.264 | 0.069 |
| −0.095 | −0.356 | 0.000 | −0.720 | 1.254 | 0.034 | −0.683 | −0.227 | 0.069 |
| 0.395 | 1.075 | 0.000 | −0.041 | −0.311 | 0.034 | −0.255 | 1.309 | 0.069 |
| 0.874 | 0.738 | 0.000 | −0.699 | −0.271 | 0.034 | −0.812 | 1.260 | 0.069 |
| 1.287 | 0.278 | 0.000 | 1.242 | −0.888 | 0.034 | −0.525 | −0.222 | 0.069 |
| 1.236 | −0.898 | 0.000 | 0.678 | −0.536 | 0.034 | 0.809 | −0.571 | 0.069 |
| 0.660 | −0.566 | 0.000 | 0.082 | −0.335 | 0.034 | 0.221 | −0.320 | 0.069 |
| 0.305 | 1.119 | 0.000 | 0.687 | 0.898 | 0.034 | 1.244 | −0.877 | 0.069 |
| 0.782 | 0.817 | 0.000 | 1.126 | 0.470 | 0.034 | 0.488 | 1.046 | 0.069 |
| 1.211 | 0.376 | 0.000 | 0.797 | −0.596 | 0.034 | 0.957 | 0.654 | 0.069 |
| 0.781 | −0.621 | 0.000 | 0.203 | −0.363 | 0.034 | 0.340 | −0.357 | 0.069 |
| 0.180 | −0.408 | 0.000 | 0.122 | 1.208 | 0.034 | 0.870 | 0.742 | 0.069 |
| 0.212 | 1.157 | 0.000 | 0.588 | 0.970 | 0.034 | 1.273 | 0.272 | 0.069 |
| 0.687 | 0.893 | 0.000 | 1.045 | 0.563 | 0.034 | 0.457 | −0.400 | 0.069 |
| 1.132 | 0.471 | 0.000 | 0.914 | −0.662 | 0.034 | 0.923 | −0.641 | 0.069 |
| 0.900 | −0.683 | 0.000 | 0.322 | −0.397 | 0.034 | 0.313 | 1.146 | 0.069 |
| 0.300 | −0.439 | 0.000 | 0.486 | 1.037 | 0.034 | 0.781 | 0.825 | 0.069 |
| 0.117 | 1.190 | 0.000 | 0.960 | 0.653 | 0.034 | 1.199 | 0.371 | 0.069 |
| 0.587 | 0.963 | 0.000 | 1.026 | −0.732 | 0.034 | 0.571 | −0.448 | 0.069 |
| 1.049 | 0.563 | 0.000 | 0.440 | −0.437 | 0.034 | 1.034 | −0.715 | 0.069 |
| 1.015 | −0.750 | 0.000 | 0.398 | 1.087 | 0.034 | 0.687 | 0.904 | 0.069 |
| 0.419 | −0.475 | 0.000 | 0.872 | 0.740 | 0.034 | 1.121 | 0.468 | 0.069 |
| 0.484 | 1.027 | 0.000 | 1.280 | 0.275 | 0.034 | 0.692 | −0.507 | 0.069 |
| 0.964 | 0.652 | 0.000 | 1.136 | −0.808 | 0.034 | 0.101 | −0.289 | 0.069 |
| 1.127 | −0.821 | 0.000 | 0.556 | −0.482 | 0.034 | 1.141 | −0.794 | 0.069 |
| 0.536 | −0.516 | 0.000 | 0.308 | 1.133 | 0.034 | 0.127 | 1.225 | 0.069 |
| 1.736 | −0.413 | 0.000 | 0.781 | 0.821 | 0.034 | 0.590 | 0.978 | 0.069 |
| 1.701 | −1.314 | 0.000 | 1.204 | 0.374 | 0.034 | 1.041 | 0.562 | 0.069 |
| 1.635 | −0.241 | 0.000 | 1.669 | −0.320 | 0.034 | 1.473 | −0.021 | 0.069 |
| 1.808 | −1.431 | 0.000 | 1.817 | −1.455 | 0.034 | 1.747 | −0.481 | 0.069 |
| 1.335 | −0.974 | 0.000 | 1.577 | −0.167 | 0.034 | 1.807 | −1.457 | 0.069 |
| 1.553 | −0.108 | 0.000 | 1.933 | −1.599 | 0.034 | 1.376 | 0.127 | 0.069 |
| 1.910 | −1.553 | 0.000 | 1.362 | −0.987 | 0.034 | 1.659 | −0.326 | 0.069 |
| 1.431 | −1.054 | 0.000 | 1.482 | −0.017 | 0.034 | 1.362 | −0.980 | 0.069 |
| 1.468 | 0.023 | 0.000 | 1.926 | −0.787 | 0.034 | 1.567 | −0.173 | 0.069 |
| 1.928 | −0.761 | 0.000 | 1.478 | −1.092 | 0.034 | 1.475 | −1.088 | 0.069 |
| 1.524 | −1.137 | 0.000 | 1.383 | 0.131 | 0.034 | 1.915 | −0.794 | 0.069 |
| 1.379 | 0.152 | 0.000 | 1.843 | −0.631 | 0.034 | 1.583 | −1.199 | 0.069 |
| 1.834 | −0.587 | 0.000 | 1.589 | −1.201 | 0.034 | 1.832 | −0.637 | 0.069 |
| 1.614 | −1.224 | 0.000 | 1.757 | −0.475 | 0.034 | 1.921 | −1.603 | 0.069 |
| 2.392 | −2.234 | 0.000 | 1.696 | −1.315 | 0.034 | 1.688 | −1.315 | 0.069 |
| 2.192 | −1.934 | 0.000 | 2.089 | −1.108 | 0.034 | 2.157 | −1.281 | 0.069 |
| 2.181 | −1.266 | 0.000 | 2.377 | −1.725 | 0.034 | 2.407 | −1.831 | 0.069 |
| 2.434 | −1.813 | 0.000 | 2.547 | −2.118 | 0.034 | 2.331 | −2.215 | 0.069 |

TABLE I-continued

| X | Y | Z' | X | Y | Z' | X | Y | Z' |
|---|---|---|---|---|---|---|---|---|
| 2.567 | −2.131 | 0.000 | 2.346 | −2.207 | 0.034 | 2.538 | −2.150 | 0.069 |
| 2.411 | −2.245 | 0.000 | 2.522 | −2.233 | 0.034 | 2.458 | −2.270 | 0.069 |
| 2.278 | −2.065 | 0.000 | 2.396 | −2.254 | 0.034 | 2.077 | −1.116 | 0.069 |
| 2.101 | −1.101 | 0.000 | 2.007 | −0.944 | 0.034 | 2.364 | −1.734 | 0.069 |
| 2.390 | −1.716 | 0.000 | 2.334 | −1.629 | 0.034 | 2.236 | −2.059 | 0.069 |
| 2.561 | −2.109 | 0.000 | 2.538 | −2.096 | 0.034 | 2.532 | −2.128 | 0.069 |
| 2.488 | −2.252 | 0.000 | 2.539 | −2.210 | 0.034 | 2.506 | −2.242 | 0.069 |
| 2.431 | −2.253 | 0.000 | 2.417 | −2.262 | 0.034 | 2.401 | −2.271 | 0.069 |
| 2.019 | −0.937 | 0.000 | 2.291 | −1.534 | 0.034 | 1.995 | −0.951 | 0.069 |
| 2.347 | −1.620 | 0.000 | 2.502 | −2.009 | 0.034 | 2.321 | −1.638 | 0.069 |
| 2.552 | −2.087 | 0.000 | 2.550 | −2.183 | 0.034 | 2.136 | −1.905 | 0.069 |
| 2.553 | −2.200 | 0.000 | 2.044 | −1.747 | 0.034 | 2.524 | −2.106 | 0.069 |
| 2.514 | −2.241 | 0.000 | 2.445 | −2.265 | 0.034 | 2.524 | −2.219 | 0.069 |
| 2.460 | −2.256 | 0.000 | 2.248 | −1.441 | 0.034 | 2.346 | −2.236 | 0.069 |
| 2.361 | −2.198 | 0.000 | 2.462 | −1.918 | 0.034 | 2.484 | −2.259 | 0.069 |
| 2.008 | −1.677 | 0.000 | 2.554 | −2.162 | 0.034 | 2.363 | −2.252 | 0.069 |
| 2.304 | −1.526 | 0.000 | 2.149 | −1.898 | 0.034 | 2.278 | −1.543 | 0.069 |
| 2.515 | −2.000 | 0.000 | 2.473 | −2.261 | 0.034 | 2.031 | −1.753 | 0.069 |
| 2.564 | −2.174 | 0.000 | 2.361 | −2.227 | 0.034 | 2.487 | −2.019 | 0.069 |
| 2.536 | −2.223 | 0.000 | 2.169 | −1.273 | 0.034 | 2.535 | −2.193 | 0.069 |
| 2.376 | −2.218 | 0.000 | 2.421 | −1.822 | 0.034 | 2.429 | −2.274 | 0.069 |
| 2.102 | −1.804 | 0.000 | 2.553 | −2.140 | 0.034 | 2.235 | −1.450 | 0.069 |
| 2.261 | −1.433 | 0.000 | 2.250 | −2.052 | 0.034 | 2.448 | −1.927 | 0.069 |
| 2.476 | −1.908 | 0.000 | 2.499 | −2.250 | 0.034 | 2.539 | −2.172 | 0.069 |
| 2.568 | −2.152 | 0.000 | 2.378 | −2.243 | 0.034 | 2.381 | −2.263 | 0.069 |
| −2.140 | 0.314 | 0.103 | −2.062 | 0.414 | 0.138 | −1.942 | −0.409 | 0.172 |
| −2.316 | 0.007 | 0.103 | −2.271 | 0.075 | 0.138 | −1.850 | 0.678 | 0.172 |
| −2.357 | −0.202 | 0.103 | −2.335 | −0.155 | 0.138 | −2.166 | 0.257 | 0.172 |
| −2.276 | −0.355 | 0.103 | −2.284 | −0.326 | 0.138 | −2.295 | −0.029 | 0.172 |
| −2.102 | −0.416 | 0.103 | −2.124 | −0.408 | 0.138 | −2.307 | −0.231 | 0.172 |
| −2.009 | 0.479 | 0.103 | −1.997 | 0.497 | 0.138 | −2.209 | −0.366 | 0.172 |
| −2.076 | 0.397 | 0.103 | −2.243 | 0.132 | 0.138 | −1.994 | −0.412 | 0.172 |
| −2.291 | 0.064 | 0.103 | −2.331 | −0.117 | 0.138 | −2.110 | 0.346 | 0.172 |
| −2.358 | −0.164 | 0.103 | −2.304 | −0.297 | 0.138 | −2.275 | 0.030 | 0.172 |
| −2.303 | −0.332 | 0.103 | −2.161 | −0.399 | 0.138 | −2.313 | −0.199 | 0.172 |
| −2.140 | −0.411 | 0.103 | −1.905 | −0.409 | 0.138 | −2.241 | −0.344 | 0.172 |
| −2.263 | 0.120 | 0.103 | −1.929 | 0.577 | 0.138 | −2.045 | −0.411 | 0.172 |
| −2.354 | −0.127 | 0.103 | −2.214 | 0.187 | 0.138 | −2.050 | 0.432 | 0.172 |
| −1.867 | 0.634 | 0.103 | −2.325 | −0.079 | 0.138 | −2.252 | 0.089 | 0.172 |
| −2.324 | −0.304 | 0.103 | −2.320 | −0.265 | 0.138 | −2.315 | −0.157 | 0.172 |
| −2.177 | −0.402 | 0.103 | −2.196 | −0.387 | 0.138 | −2.267 | −0.317 | 0.172 |
| −1.921 | −0.413 | 0.103 | −1.966 | −0.415 | 0.138 | −2.096 | −0.406 | 0.172 |
| −2.232 | 0.174 | 0.103 | −1.858 | 0.656 | 0.138 | −1.986 | 0.517 | 0.172 |
| −2.347 | −0.089 | 0.103 | −2.182 | 0.241 | 0.138 | −2.226 | 0.146 | 0.172 |
| −2.341 | −0.272 | 0.103 | −2.315 | −0.042 | 0.138 | −2.312 | −0.114 | 0.172 |
| −2.213 | −0.390 | 0.103 | −2.330 | −0.229 | 0.138 | −2.285 | −0.291 | 0.172 |
| −1.981 | −0.418 | 0.103 | −2.229 | −0.371 | 0.138 | −2.136 | −0.397 | 0.172 |
| −2.199 | 0.228 | 0.103 | −2.026 | −0.418 | 0.138 | −1.891 | −0.402 | 0.172 |
| −2.337 | −0.052 | 0.103 | −2.124 | 0.329 | 0.138 | −1.919 | 0.599 | 0.172 |
| −1.939 | 0.558 | 0.103 | −2.295 | 0.017 | 0.138 | −2.197 | 0.202 | 0.172 |
| −2.351 | −0.238 | 0.103 | −2.334 | −0.193 | 0.138 | −2.305 | −0.071 | 0.172 |
| −2.246 | −0.375 | 0.103 | −2.259 | −0.350 | 0.138 | −2.298 | −0.262 | 0.172 |
| −2.042 | −0.420 | 0.103 | −2.086 | −0.414 | 0.138 | −2.174 | −0.384 | 0.172 |
| −1.792 | 0.708 | 0.103 | −1.226 | −0.243 | 0.138 | −1.545 | −0.317 | 0.172 |
| −1.359 | 1.049 | 0.103 | −1.267 | 1.130 | 0.138 | −1.631 | −0.343 | 0.172 |
| −1.698 | −0.375 | 0.103 | −1.704 | 0.808 | 0.138 | −1.350 | 1.108 | 0.172 |
| −1.627 | 0.856 | 0.103 | −1.808 | −0.393 | 0.138 | −1.778 | 0.755 | 0.172 |
| −1.810 | −0.397 | 0.103 | −1.324 | −0.269 | 0.138 | −1.717 | −0.366 | 0.172 |
| −1.252 | −0.273 | 0.103 | −1.621 | 0.881 | 0.138 | −1.698 | 0.833 | 0.172 |
| −1.451 | 0.989 | 0.103 | −1.421 | −0.295 | 0.138 | −1.804 | −0.386 | 0.172 |
| −1.364 | −0.298 | 0.103 | −1.535 | 0.951 | 0.138 | −1.289 | −0.237 | 0.172 |
| −1.711 | 0.784 | 0.103 | −1.517 | −0.322 | 0.138 | −1.616 | 0.908 | 0.172 |
| −1.476 | −0.324 | 0.103 | −1.446 | 1.017 | 0.138 | −1.459 | −0.290 | 0.172 |
| −1.541 | 0.924 | 0.103 | −1.614 | −0.348 | 0.138 | −1.531 | 0.979 | 0.172 |
| −1.587 | −0.350 | 0.103 | −1.784 | 0.731 | 0.138 | −0.047 | 1.341 | 0.172 |
| −0.805 | 1.290 | 0.103 | −1.711 | −0.372 | 0.138 | −0.871 | −0.129 | 0.172 |
| −1.140 | −0.249 | 0.103 | −0.333 | 1.365 | 0.138 | −0.277 | −0.084 | 0.172 |
| −0.512 | −0.175 | 0.103 | −0.628 | −0.136 | 0.138 | −0.988 | 1.290 | 0.172 |
| −0.248 | 1.333 | 0.103 | −0.077 | −0.156 | 0.138 | −0.995 | −0.156 | 0.172 |
| −1.183 | 1.148 | 0.103 | −0.754 | −0.149 | 0.138 | −0.419 | 1.393 | 0.172 |
| −0.639 | −0.180 | 0.103 | −0.700 | 1.341 | 0.138 | −0.384 | −0.081 | 0.172 |
| −0.007 | −0.217 | 0.103 | −0.182 | −0.141 | 0.138 | −1.118 | −0.188 | 0.172 |
| −0.615 | 1.327 | 0.103 | −0.150 | 1.342 | 0.138 | −0.491 | −0.082 | 0.172 |
| −0.765 | −0.191 | 0.103 | −0.880 | −0.168 | 0.138 | −0.794 | 1.349 | 0.172 |
| −0.132 | −0.196 | 0.103 | −0.288 | −0.132 | 0.138 | 0.038 | −0.131 | 0.172 |
| −0.059 | 1.300 | 0.103 | −1.086 | 1.221 | 0.138 | −0.236 | 1.380 | 0.172 |
| −0.998 | 1.229 | 0.103 | −1.005 | −0.191 | 0.138 | −0.619 | −0.091 | 0.172 |

TABLE I-continued

| X | Y | Z' | X | Y | Z' | X | Y | Z' |
|---|---|---|---|---|---|---|---|---|
| −0.891 | −0.207 | 0.103 | −0.517 | 1.364 | 0.138 | −0.066 | −0.110 | 0.172 |
| −0.258 | −0.183 | 0.103 | −0.394 | −0.128 | 0.138 | −1.174 | 1.208 | 0.172 |
| −0.432 | 1.341 | 0.103 | 0.044 | 1.293 | 0.138 | −0.745 | −0.107 | 0.172 |
| −1.016 | −0.226 | 0.103 | −1.128 | −0.219 | 0.138 | −0.603 | 1.383 | 0.172 |
| −0.385 | −0.176 | 0.103 | −0.500 | −0.129 | 0.138 | −0.171 | −0.094 | 0.172 |
| 0.133 | 1.241 | 0.103 | −0.897 | 1.292 | 0.138 | 0.863 | 0.749 | 0.172 |
| 0.236 | −0.278 | 0.103 | 0.027 | −0.175 | 0.138 | 0.237 | −0.189 | 0.172 |
| 0.818 | −0.547 | 0.103 | 0.481 | −0.330 | 0.138 | 0.716 | −0.426 | 0.172 |
| 1.116 | 0.466 | 0.103 | 1.040 | −0.682 | 0.138 | 1.237 | −0.846 | 0.172 |
| 0.688 | 0.909 | 0.103 | 1.111 | 0.465 | 0.138 | 0.967 | 0.633 | 0.172 |
| 0.116 | −0.244 | 0.103 | 0.688 | 0.914 | 0.138 | 0.495 | 1.075 | 0.172 |
| 0.702 | −0.479 | 0.103 | 0.231 | 1.218 | 0.138 | 0.141 | −0.158 | 0.172 |
| 1.244 | −0.867 | 0.103 | 0.367 | −0.280 | 0.138 | 0.601 | −0.356 | 0.172 |
| 1.193 | 0.368 | 0.103 | 0.934 | −0.601 | 0.138 | 1.140 | −0.755 | 0.172 |
| 0.780 | 0.828 | 0.103 | 1.186 | 0.366 | 0.138 | 1.066 | 0.513 | 0.172 |
| 0.317 | 1.159 | 0.103 | 0.779 | 0.832 | 0.138 | 0.593 | 1.000 | 0.172 |
| 0.583 | −0.416 | 0.103 | 0.249 | −0.237 | 0.138 | 0.143 | 1.275 | 0.172 |
| 1.143 | −0.781 | 0.103 | 0.824 | −0.524 | 0.138 | 0.513 | −0.308 | 0.172 |
| 1.267 | 0.268 | 0.103 | 1.259 | 0.265 | 0.138 | 1.040 | −0.666 | 0.172 |
| 0.869 | 0.744 | 0.103 | 0.866 | 0.746 | 0.138 | 1.160 | 0.389 | 0.172 |
| 0.470 | −0.364 | 0.103 | 0.409 | 1.121 | 0.138 | 0.687 | 0.920 | 0.172 |
| 1.038 | −0.698 | 0.103 | 0.130 | −0.201 | 0.138 | 0.423 | −0.264 | 0.172 |
| 0.955 | 0.654 | 0.103 | 0.711 | −0.452 | 0.138 | 0.936 | −0.582 | 0.172 |
| 0.491 | 1.056 | 0.103 | 1.241 | −0.856 | 0.138 | 1.250 | 0.263 | 0.172 |
| 0.354 | −0.318 | 0.103 | 0.951 | 0.655 | 0.138 | 0.777 | 0.836 | 0.172 |
| 0.930 | −0.620 | 0.103 | 0.593 | −0.385 | 0.138 | 0.324 | 1.185 | 0.172 |
| 1.037 | 0.561 | 0.103 | 1.142 | −0.768 | 0.138 | 0.330 | −0.224 | 0.172 |
| 1.359 | −0.973 | 0.103 | 1.032 | 0.561 | 0.138 | 0.828 | −0.501 | 0.172 |
| 1.908 | −1.607 | 0.103 | 0.593 | 0.992 | 0.138 | 1.768 | −1.462 | 0.172 |
| 1.558 | −0.178 | 0.103 | 1.566 | −1.195 | 0.138 | 1.470 | −0.078 | 0.172 |
| 1.796 | −1.459 | 0.103 | 1.586 | −0.248 | 0.138 | 1.654 | −1.314 | 0.172 |
| 1.648 | −0.332 | 0.103 | 1.462 | −1.078 | 0.138 | 1.574 | −0.253 | 0.172 |
| 1.678 | −1.315 | 0.103 | 1.687 | −0.426 | 0.138 | 1.555 | −1.192 | 0.172 |
| 1.736 | −0.487 | 0.103 | 1.354 | −0.965 | 0.138 | 1.674 | −0.430 | 0.172 |
| 1.576 | −1.197 | 0.103 | 1.894 | −1.611 | 0.138 | 1.453 | −1.073 | 0.172 |
| 1.821 | −0.643 | 0.103 | 1.784 | −0.604 | 0.138 | 1.771 | −0.610 | 0.172 |
| 1.368 | 0.123 | 0.103 | 1.783 | −1.461 | 0.138 | 1.347 | −0.958 | 0.172 |
| 1.469 | −1.083 | 0.103 | 1.878 | −0.785 | 0.138 | 1.878 | −1.614 | 0.172 |
| 1.903 | −0.801 | 0.103 | 1.373 | 0.098 | 0.138 | 1.864 | −0.790 | 0.172 |
| 1.464 | −0.026 | 0.103 | 1.667 | −1.314 | 0.138 | 1.363 | 0.095 | 0.172 |
| 2.385 | −2.280 | 0.103 | 1.482 | −0.074 | 0.138 | 2.338 | −1.808 | 0.172 |
| 2.508 | −2.229 | 0.103 | 2.473 | −2.261 | 0.138 | 2.310 | −2.277 | 0.172 |
| 2.509 | −2.116 | 0.103 | 2.312 | −2.253 | 0.138 | 2.431 | −2.287 | 0.172 |
| 2.307 | −1.647 | 0.103 | 2.376 | −1.848 | 0.138 | 2.279 | −2.240 | 0.172 |
| 1.983 | −0.958 | 0.103 | 2.104 | −1.918 | 0.138 | 1.955 | −0.972 | 0.172 |
| 2.365 | −2.272 | 0.103 | 2.090 | −1.214 | 0.138 | 2.442 | −2.056 | 0.172 |
| 2.490 | −2.251 | 0.103 | 2.396 | −2.292 | 0.138 | 2.265 | −1.640 | 0.172 |
| 2.517 | −2.138 | 0.103 | 2.502 | −2.212 | 0.138 | 2.228 | −1.557 | 0.172 |
| 2.349 | −1.743 | 0.103 | 2.417 | −1.943 | 0.138 | 2.293 | −2.261 | 0.172 |
| 2.064 | −1.124 | 0.103 | 2.001 | −1.763 | 0.138 | 2.405 | −2.297 | 0.172 |
| 2.346 | −2.260 | 0.103 | 2.207 | −1.467 | 0.138 | 2.185 | −2.082 | 0.172 |
| 2.468 | −2.269 | 0.103 | 2.450 | −2.278 | 0.138 | 2.075 | −1.222 | 0.172 |
| 2.220 | −2.067 | 0.103 | 2.506 | −2.169 | 0.138 | 2.487 | −2.178 | 0.172 |
| 2.522 | −2.160 | 0.103 | 2.456 | −2.036 | 0.138 | 2.373 | −1.892 | 0.172 |
| 2.392 | −1.840 | 0.103 | 2.250 | −1.561 | 0.138 | 2.376 | −2.300 | 0.172 |
| 2.144 | −1.290 | 0.103 | 2.367 | −2.288 | 0.138 | 2.086 | −1.924 | 0.172 |
| 2.330 | −2.244 | 0.103 | 2.491 | −2.238 | 0.138 | 2.192 | −1.475 | 0.172 |
| 2.441 | −2.279 | 0.103 | 2.492 | −2.125 | 0.138 | 2.474 | −2.134 | 0.172 |
| 2.121 | −1.912 | 0.103 | 2.292 | −1.655 | 0.138 | 2.301 | −1.723 | 0.172 |
| 2.523 | −2.181 | 0.103 | 2.298 | −2.232 | 0.138 | 2.348 | −2.297 | 0.172 |
| 2.433 | −1.935 | 0.103 | 2.500 | −2.147 | 0.138 | 1.984 | −1.768 | 0.172 |
| 2.222 | −1.458 | 0.103 | 2.424 | −2.288 | 0.138 | 2.472 | −2.247 | 0.172 |
| 2.315 | −2.224 | 0.103 | 2.506 | −2.191 | 0.138 | 2.488 | −2.200 | 0.172 |
| 2.413 | −2.283 | 0.103 | 2.329 | −2.269 | 0.138 | 2.408 | −1.975 | 0.172 |
| 2.017 | −1.758 | 0.103 | 2.334 | −1.751 | 0.138 | 2.484 | −2.221 | 0.172 |
| 2.519 | −2.203 | 0.103 | 2.203 | −2.075 | 0.138 | 2.328 | −2.289 | 0.172 |
| 2.472 | −2.027 | 0.103 | 1.970 | −0.965 | 0.138 | 2.454 | −2.270 | 0.172 |
| 2.264 | −1.552 | 0.103 | 2.347 | −2.281 | 0.138 | 2.482 | −2.156 | 0.172 |
| −2.252 | −0.305 | 0.207 | −2.263 | 0.004 | 0.241 | −1.966 | 0.585 | 0.276 |
| −2.115 | −0.389 | 0.207 | −2.276 | −0.201 | 0.241 | −2.189 | 0.203 | 0.276 |
| −1.877 | −0.392 | 0.207 | −2.193 | −0.333 | 0.241 | −2.267 | −0.061 | 0.276 |
| −1.977 | 0.538 | 0.207 | −2.019 | −0.389 | 0.241 | −2.243 | −0.242 | 0.276 |
| −2.211 | 0.163 | 0.207 | −2.089 | 0.386 | 0.241 | −2.123 | −0.346 | 0.276 |
| −2.294 | −0.099 | 0.207 | −2.245 | 0.064 | 0.241 | −1.904 | −0.366 | 0.276 |
| −2.269 | −0.278 | 0.207 | −2.280 | −0.168 | 0.241 | −1.902 | 0.670 | 0.276 |
| −2.148 | −0.379 | 0.207 | −2.218 | −0.313 | 0.241 | −2.163 | 0.260 | 0.276 |
| −1.929 | −0.399 | 0.207 | −2.070 | −0.383 | 0.241 | −2.261 | −0.018 | 0.276 |

TABLE I-continued

| X | Y | Z' | X | Y | Z' | X | Y | Z' |
|---|---|---|---|---|---|---|---|---|
| −1.912 | 0.621 | 0.207 | −1.692 | −0.334 | 0.241 | −2.255 | −0.212 | 0.276 |
| −2.183 | 0.219 | 0.207 | −1.346 | 1.167 | 0.241 | −2.153 | −0.332 | 0.276 |
| −2.288 | −0.056 | 0.207 | −1.768 | 0.806 | 0.241 | −1.956 | −0.371 | 0.276 |
| −2.281 | −0.249 | 0.207 | −1.778 | −0.358 | 0.241 | −1.836 | 0.753 | 0.276 |
| −2.178 | −0.365 | 0.207 | −1.270 | −0.181 | 0.241 | −2.134 | 0.317 | 0.276 |
| −1.980 | −0.403 | 0.207 | −1.101 | −0.121 | 0.241 | −2.252 | 0.025 | 0.276 |
| −1.843 | 0.702 | 0.207 | −0.413 | 1.444 | 0.241 | −2.263 | −0.181 | 0.276 |
| −2.153 | 0.275 | 0.207 | −0.582 | 0.000 | 0.241 | −2.181 | −0.315 | 0.276 |
| −2.278 | −0.014 | 0.207 | −0.047 | −0.021 | 0.241 | −2.007 | −0.371 | 0.276 |
| −2.290 | −0.218 | 0.207 | −0.689 | −0.015 | 0.241 | −1.766 | 0.833 | 0.276 |
| −2.206 | −0.348 | 0.207 | −0.788 | 1.408 | 0.241 | −2.082 | 0.409 | 0.276 |
| −2.032 | −0.402 | 0.207 | −0.153 | −0.003 | 0.241 | −2.234 | 0.085 | 0.276 |
| −2.098 | 0.365 | 0.207 | −1.691 | 0.886 | 0.241 | −2.268 | −0.148 | 0.276 |
| −2.259 | 0.046 | 0.207 | −2.032 | 0.475 | 0.241 | −2.206 | −0.294 | 0.276 |
| −2.295 | −0.185 | 0.207 | −2.223 | 0.124 | 0.241 | −2.058 | −0.365 | 0.276 |
| −2.231 | −0.328 | 0.207 | −2.282 | −0.125 | 0.241 | −1.766 | −0.338 | 0.276 |
| −2.082 | −0.397 | 0.207 | −2.239 | −0.289 | 0.241 | −2.026 | 0.498 | 0.276 |
| −2.040 | 0.453 | 0.207 | −2.103 | −0.375 | 0.241 | −2.213 | 0.145 | 0.276 |
| −2.236 | 0.105 | 0.207 | −1.865 | −0.377 | 0.241 | −2.270 | −0.105 | 0.276 |
| −2.297 | −0.142 | 0.207 | −1.437 | −0.244 | 0.241 | −2.226 | −0.270 | 0.276 |
| −1.448 | −0.268 | 0.207 | −0.230 | 1.426 | 0.241 | −2.091 | −0.357 | 0.276 |
| −1.612 | 0.935 | 0.207 | −0.794 | −0.035 | 0.241 | −1.853 | −0.358 | 0.276 |
| −1.533 | −0.298 | 0.207 | −0.260 | 0.008 | 0.241 | −1.512 | −0.250 | 0.276 |
| −1.619 | −0.326 | 0.207 | −1.170 | 1.269 | 0.241 | −1.526 | 1.064 | 0.276 |
| −1.439 | 1.074 | 0.207 | −1.970 | 0.561 | 0.241 | −1.596 | −0.283 | 0.276 |
| −1.704 | −0.352 | 0.207 | −2.198 | 0.182 | 0.241 | −1.681 | −0.312 | 0.276 |
| −1.772 | 0.780 | 0.207 | −2.279 | −0.082 | 0.241 | −1.346 | 1.196 | 0.276 |
| −1.791 | −0.374 | 0.207 | −2.255 | −0.262 | 0.241 | −1.262 | −0.150 | 0.276 |
| −1.279 | −0.210 | 0.207 | −2.135 | −0.365 | 0.241 | −1.689 | 0.913 | 0.276 |
| −1.260 | 1.190 | 0.207 | −1.916 | −0.385 | 0.241 | −1.427 | −0.216 | 0.276 |
| −1.694 | 0.859 | 0.207 | −1.522 | −0.276 | 0.241 | −0.891 | −0.020 | 0.276 |
| −0.801 | −0.076 | 0.207 | −0.897 | −0.060 | 0.241 | −0.597 | 1.465 | 0.276 |
| −0.691 | 1.399 | 0.207 | −0.597 | 1.439 | 0.241 | −0.361 | 0.057 | 0.276 |
| −0.268 | −0.038 | 0.207 | −0.367 | 0.012 | 0.241 | −0.993 | −0.051 | 0.276 |
| −0.141 | 1.386 | 0.207 | −1.526 | 1.035 | 0.241 | −0.469 | 0.054 | 0.276 |
| −0.904 | −0.099 | 0.207 | −1.906 | 0.645 | 0.241 | −0.983 | 1.379 | 0.276 |
| −0.375 | −0.034 | 0.207 | −2.171 | 0.239 | 0.241 | 0.064 | −0.006 | 0.276 |
| −1.079 | 1.282 | 0.207 | −2.273 | −0.039 | 0.241 | −0.042 | 1.400 | 0.276 |
| −1.007 | −0.125 | 0.207 | −2.267 | −0.232 | 0.241 | −1.094 | −0.086 | 0.276 |
| −0.507 | 1.418 | 0.207 | −2.165 | −0.351 | 0.241 | −0.412 | 1.469 | 0.276 |
| −0.482 | −0.036 | 0.207 | −1.968 | −0.389 | 0.241 | −0.576 | 0.045 | 0.276 |
| 0.048 | −0.088 | 0.207 | −1.607 | −0.306 | 0.241 | −0.040 | 0.021 | 0.276 |
| 0.052 | 1.329 | 0.207 | −0.042 | 1.381 | 0.241 | −0.682 | 0.029 | 0.276 |
| −1.109 | −0.155 | 0.207 | −1.000 | −0.089 | 0.241 | −0.788 | 1.436 | 0.276 |
| −0.589 | −0.044 | 0.207 | −0.475 | 0.009 | 0.241 | −0.146 | 0.040 | 0.276 |
| −0.888 | 1.352 | 0.207 | −0.983 | 1.350 | 0.241 | −0.229 | 1.448 | 0.276 |
| −0.056 | −0.065 | 0.207 | 0.057 | −0.046 | 0.241 | −0.787 | 0.007 | 0.276 |
| −0.323 | 1.414 | 0.207 | −1.839 | 0.727 | 0.241 | −0.253 | 0.052 | 0.276 |
| −0.696 | −0.058 | 0.207 | −2.142 | 0.295 | 0.241 | −1.170 | 1.298 | 0.276 |
| −0.161 | −0.048 | 0.207 | 0.492 | 1.095 | 0.241 | 1.211 | −0.820 | 0.276 |
| 1.151 | 0.389 | 0.207 | 0.850 | 0.757 | 0.241 | 0.841 | 0.763 | 0.276 |
| 0.684 | 0.927 | 0.207 | 0.436 | −0.198 | 0.241 | 0.166 | −0.040 | 0.276 |
| 0.237 | 1.247 | 0.207 | 0.933 | −0.547 | 0.241 | 0.611 | −0.276 | 0.276 |
| 0.246 | −0.150 | 0.207 | 0.587 | 1.017 | 0.241 | 1.120 | −0.721 | 0.276 |
| 0.720 | −0.401 | 0.207 | 1.338 | 0.091 | 0.241 | 0.672 | 0.942 | 0.276 |
| 1.230 | −0.837 | 0.207 | 1.429 | −1.065 | 0.241 | 1.126 | 0.392 | 0.276 |
| 1.240 | 0.262 | 0.207 | 1.643 | −0.438 | 0.241 | 0.527 | −0.220 | 0.276 |
| 0.773 | 0.841 | 0.207 | 2.387 | −2.303 | 0.241 | 1.026 | −0.624 | 0.276 |
| 0.151 | −0.117 | 0.207 | 2.123 | −2.064 | 0.241 | 0.941 | 0.643 | 0.276 |
| 0.606 | −0.327 | 0.207 | 2.444 | −2.195 | 0.241 | 0.487 | 1.106 | 0.276 |
| 1.136 | −0.743 | 0.207 | 2.331 | −1.906 | 0.241 | 1.214 | 0.262 | 0.276 |
| 0.858 | 0.752 | 0.207 | 2.154 | −1.490 | 0.241 | 0.440 | −0.168 | 0.276 |
| 0.411 | 1.143 | 0.207 | 2.250 | −2.277 | 0.241 | 0.929 | −0.531 | 0.276 |
| 0.519 | −0.277 | 0.207 | 2.361 | −2.314 | 0.241 | 0.758 | 0.854 | 0.276 |
| 1.038 | −0.652 | 0.207 | 2.005 | −1.873 | 0.241 | 1.323 | 0.091 | 0.276 |
| 0.960 | 0.635 | 0.207 | 2.444 | −2.217 | 0.241 | 0.322 | 1.224 | 0.276 |
| 0.430 | −0.230 | 0.207 | 2.366 | −1.989 | 0.241 | 0.351 | −0.120 | 0.276 |
| 0.936 | −0.564 | 0.207 | 2.190 | −1.572 | 0.241 | 0.827 | −0.441 | 0.276 |
| 1.058 | 0.514 | 0.207 | 1.140 | 0.390 | 0.241 | 1.314 | −0.939 | 0.276 |
| 0.591 | 1.008 | 0.207 | 0.147 | 1.308 | 0.241 | 1.035 | 0.519 | 0.276 |
| 0.339 | −0.188 | 0.207 | 0.679 | 0.934 | 0.241 | 0.582 | 1.026 | 0.276 |
| 0.830 | −0.480 | 0.207 | 0.346 | −0.153 | 0.241 | 0.145 | 1.324 | 0.276 |
| 1.938 | −0.978 | 0.207 | 0.830 | −0.460 | 0.241 | 8.259 | −0.078 | 0.276 |
| 1.774 | −1.494 | 0.207 | 1.327 | −0.945 | 0.241 | 0.721 | −0.356 | 0.276 |
| 1.756 | −0.614 | 0.207 | 2.332 | −2.317 | 0.241 | 2.259 | −2.313 | 0.276 |
| 1.640 | −1.313 | 0.207 | 1.883 | −1.683 | 0.241 | 1.735 | −1.498 | 0.276 |
| 1.351 | 0.092 | 0.207 | 2.440 | −2.238 | 0.241 | 2.385 | −2.294 | 0.276 |

TABLE I-continued

| X | Y | Z' | X | Y | Z' | X | Y | Z' |
|---|---|---|---|---|---|---|---|---|
| 1.560 | −0.256 | 0.207 | 2.399 | −2.071 | 0.241 | 2.414 | −2.180 | 0.276 |
| 1.458 | −0.080 | 0.207 | 2.225 | −1.655 | 0.241 | 2.273 | −1.828 | 0.276 |
| 1.543 | −1.190 | 0.207 | 1.443 | −0.082 | 0.241 | 2.018 | −1.240 | 0.276 |
| 1.848 | −0.796 | 0.207 | 1.831 | −0.800 | 0.241 | 1.528 | −0.261 | 0.276 |
| 1.442 | −1.069 | 0.207 | 0.951 | 0.638 | 0.241 | 2.241 | −2.301 | 0.276 |
| 1.660 | −0.434 | 0.207 | 0.253 | −0.113 | 0.241 | 1.605 | −1.313 | 0.276 |
| 1.338 | −0.951 | 0.207 | 0.722 | −0.378 | 0.241 | 2.363 | −2.311 | 0.276 |
| 1.903 | −1.679 | 0.207 | 1.222 | −0.828 | 0.241 | 2.419 | −2.202 | 0.276 |
| 2.422 | −2.064 | 0.207 | 2.304 | −2.313 | 0.241 | 2.307 | −1.912 | 0.276 |
| 2.282 | −1.731 | 0.207 | 1.755 | −1.496 | 0.241 | 2.131 | −1.496 | 0.276 |
| 2.318 | −1.815 | 0.207 | 2.428 | −2.264 | 0.241 | 1.625 | −0.440 | 0.276 |
| 2.327 | −2.305 | 0.207 | 2.431 | −2.151 | 0.241 | 2.225 | −2.284 | 0.276 |
| 2.451 | −2.256 | 0.207 | 1.738 | −0.618 | 0.241 | 1.511 | −1.186 | 0.276 |
| 2.453 | −2.143 | 0.207 | 2.261 | −1.738 | 0.241 | 2.336 | −2.321 | 0.276 |
| 2.210 | −1.565 | 0.207 | 1.920 | −0.982 | 0.241 | 2.098 | −2.071 | 0.276 |
| 2.307 | −2.297 | 0.207 | 1.228 | 0.262 | 0.241 | 2.419 | −2.224 | 0.276 |
| 2.433 | −2.278 | 0.207 | 0.325 | 1.211 | 0.241 | 2.341 | −1.995 | 0.276 |
| 2.461 | −2.165 | 0.207 | 0.767 | 0.847 | 0.241 | 2.167 | −1.578 | 0.276 |
| 2.058 | −1.229 | 0.207 | 0.159 | −0.078 | 0.241 | 1.719 | −0.621 | 0.276 |
| 2.289 | −2.285 | 0.207 | 0.610 | −0.301 | 0.241 | 2.210 | −2.264 | 0.276 |
| 2.410 | −2.295 | 0.207 | 1.129 | −0.731 | 0.241 | 1.414 | −1.061 | 0.276 |
| 2.145 | −2.058 | 0.207 | 2.284 | −2.305 | 0.241 | 2.308 | −2.324 | 0.276 |
| 2.467 | −2.187 | 0.207 | 1.624 | −1.313 | 0.241 | 1.982 | −1.878 | 0.276 |
| 2.354 | −1.899 | 0.207 | 2.410 | −2.286 | 0.241 | 2.415 | −2.245 | 0.276 |
| 2.246 | −1.648 | 0.207 | 2.235 | −2.256 | 0.241 | 2.374 | −2.078 | 0.276 |
| 2.272 | −2.269 | 0.207 | 2.439 | −2.173 | 0.241 | 2.202 | −1.661 | 0.276 |
| 2.384 | −2.306 | 0.207 | 2.296 | −1.822 | 0.241 | 1.811 | −0.803 | 0.276 |
| 2.027 | −1.867 | 0.207 | 1.545 | −0.259 | 0.241 | 2.279 | −2.320 | 0.276 |
| 2.467 | −2.208 | 0.207 | 2.039 | −1.235 | 0.241 | 1.861 | −1.687 | 0.276 |
| 2.388 | −1.982 | 0.207 | 1.048 | 0.516 | 0.241 | 2.403 | −2.271 | 0.276 |
| 2.174 | −1.483 | 0.207 | 0.524 | −0.247 | 0.241 | 2.406 | −2.158 | 0.276 |
| 2.258 | −2.249 | 0.207 | 1.033 | −0.637 | 0.241 | 2.238 | −1.744 | 0.276 |
| 2.356 | −2.309 | 0.207 | 2.266 | −2.293 | 0.241 | 1.900 | −0.987 | 0.276 |
| 2.463 | −2.230 | 0.207 | 1.528 | −1.188 | 0.241 | 1.427 | −0.083 | 0.276 |
| −1.765 | 0.860 | 0.310 | −1.899 | 0.724 | 0.345 | −2.196 | 0.220 | 0.379 |
| −2.077 | 0.433 | 0.310 | −2.158 | 0.295 | 0.345 | −2.244 | −0.016 | 0.379 |
| −2.242 | 0.047 | 0.310 | −2.248 | −0.004 | 0.345 | −2.194 | −0.193 | 0.379 |
| −2.252 | −0.158 | 0.310 | −2.223 | −0.190 | 0.345 | −1.835 | 0.837 | 0.379 |
| −2.170 | −0.292 | 0.310 | −2.100 | −0.298 | 0.345 | −2.023 | −0.286 | 0.379 |
| −1.996 | −0.349 | 0.310 | −1.881 | −0.315 | 0.345 | −1.742 | −0.253 | 0.379 |
| −2.022 | 0.523 | 0.310 | −1.834 | 0.808 | 0.345 | −1.961 | 0.666 | 0.379 |
| −2.221 | 0.123 | 0.310 | −2.124 | 0.366 | 0.345 | −2.174 | 0.279 | 0.379 |
| −2.257 | −0.125 | 0.310 | −2.243 | 0.034 | 0.345 | −2.242 | 0.022 | 0.379 |
| −2.194 | −0.271 | 0.310 | −2.237 | −0.156 | 0.345 | −2.213 | −0.162 | 0.379 |
| −2.046 | −0.343 | 0.310 | −2.131 | −0.284 | 0.345 | −2.063 | −0.277 | 0.379 |
| −1.764 | −0.316 | 0.310 | −1.933 | −0.321 | 0.345 | −1.818 | −0.273 | 0.379 |
| −1.963 | 0.611 | 0.310 | −1.766 | 0.888 | 0.345 | −2.019 | 0.578 | 0.379 |
| −2.194 | 0.197 | 0.310 | −2.074 | 0.459 | 0.345 | −2.149 | 0.337 | 0.379 |
| −2.259 | −0.082 | 0.310 | −2.236 | 0.072 | 0.345 | −2.237 | 0.061 | 0.379 |
| −2.215 | −0.247 | 0.310 | −2.245 | −0.120 | 0.345 | −2.228 | −0.128 | 0.379 |
| −2.080 | −0.335 | 0.310 | −2.158 | −0.266 | 0.345 | −2.101 | −0.263 | 0.379 |
| −1.841 | −0.334 | 0.310 | −1.984 | −0.322 | 0.345 | −1.870 | −0.283 | 0.379 |
| −1.900 | 0.697 | 0.310 | −2.020 | 0.550 | 0.345 | −2.073 | 0.487 | 0.379 |
| −2.163 | 0.270 | 0.310 | −2.215 | 0.148 | 0.345 | −2.122 | 0.394 | 0.379 |
| −2.257 | −0.039 | 0.310 | −2.250 | −0.082 | 0.345 | −2.230 | 0.099 | 0.379 |
| −2.231 | −0.220 | 0.310 | −2.183 | −0.246 | 0.345 | −2.237 | −0.092 | 0.379 |
| −2.112 | −0.324 | 0.310 | −2.035 | −0.316 | 0.345 | −2.136 | −0.245 | 0.379 |
| −1.893 | −0.343 | 0.310 | −1.753 | −0.286 | 0.345 | −1.921 | −0.289 | 0.379 |
| −1.834 | 0.780 | 0.310 | −1.961 | 0.638 | 0.345 | −2.215 | 0.160 | 0.379 |
| −2.128 | 0.341 | 0.310 | −2.189 | 0.223 | 0.345 | −2.242 | −0.055 | 0.379 |
| −2.251 | 0.005 | 0.310 | −2.251 | −0.043 | 0.345 | −2.168 | −0.221 | 0.379 |
| −2.244 | −0.190 | 0.310 | −2.204 | −0.222 | 0.345 | −1.972 | −0.291 | 0.379 |
| −2.142 | −0.310 | 0.310 | −2.068 | −0.309 | 0.345 | −1.900 | 0.753 | 0.379 |
| −1.944 | −0.348 | 0.310 | −1.830 | −0.306 | 0.345 | −1.354 | 1.286 | 0.379 |
| −1.348 | 1.226 | 0.310 | −1.528 | −0.203 | 0.345 | −1.693 | 1.000 | 0.379 |
| −1.688 | −0.292 | 0.310 | −1.602 | −0.234 | 0.345 | −1.299 | −0.066 | 0.379 |
| −1.689 | 0.942 | 0.310 | −1.677 | −0.262 | 0.345 | −1.532 | 1.152 | 0.379 |
| −1.316 | −0.142 | 0.310 | −1.264 | 1.309 | 0.345 | −1.444 | −0.133 | 0.379 |
| −1.463 | −0.205 | 0.310 | −1.308 | −0.106 | 0.345 | −1.517 | −0.167 | 0.379 |
| −1.527 | 1.093 | 0.310 | −1.442 | 1.192 | 0.345 | −1.592 | −0.198 | 0.379 |
| −1.538 | −0.236 | 0.310 | −1.612 | 1.048 | 0.345 | −1.666 | −0.228 | 0.379 |
| −1.613 | −0.265 | 0.310 | −1.453 | −0.171 | 0.345 | −1.179 | 1.387 | 0.379 |
| −0.044 | 1.419 | 0.310 | −0.430 | 0.143 | 0.345 | −1.153 | −0.001 | 0.379 |
| −1.168 | −0.081 | 0.310 | 0.024 | 0.083 | 0.345 | −0.701 | 0.152 | 0.379 |
| −0.619 | 0.082 | 0.310 | −0.325 | 1.506 | 0.345 | −0.239 | 0.178 | 0.379 |
| −0.160 | 0.085 | 0.310 | −0.983 | 0.027 | 0.345 | −0.053 | 1.453 | 0.379 |
| −0.231 | 1.469 | 0.310 | −0.522 | 0.137 | 0.345 | −0.992 | 1.466 | 0.379 |

TABLE I-continued

| X | Y | Z' | X | Y | Z' | X | Y | Z' |
|---|---|---|---|---|---|---|---|---|
| −0.732 | 0.060 | 0.310 | −0.064 | 0.108 | 0.345 | −0.794 | 0.129 | 0.379 |
| −0.252 | 0.096 | 0.310 | −1.082 | 1.401 | 0.345 | −0.331 | 0.185 | 0.379 |
| −1.172 | 1.328 | 0.310 | −0.509 | 1.520 | 0.345 | −0.421 | 1.538 | 0.379 |
| −0.414 | 1.493 | 0.310 | −1.072 | −0.006 | 0.345 | −0.885 | 0.101 | 0.379 |
| −0.844 | 0.032 | 0.310 | −0.613 | 0.126 | 0.345 | −0.423 | 0.186 | 0.379 |
| −0.344 | 0.101 | 0.310 | −0.154 | 0.126 | 0.345 | 0.030 | 0.117 | 0.379 |
| −0.953 | −0.001 | 0.310 | −0.144 | 1.467 | 0.345 | −0.797 | 1.518 | 0.379 |
| −0.598 | 1.491 | 0.310 | −0.693 | 1.508 | 0.345 | −0.976 | 0.070 | 0.379 |
| −0.436 | 0.100 | 0.310 | −1.161 | −0.042 | 0.345 | −0.515 | 0.181 | 0.379 |
| −0.985 | 1.408 | 0.310 | −0.707 | 0.108 | 0.345 | −0.058 | 0.144 | 0.379 |
| 0.019 | 0.047 | 0.310 | −0.245 | 0.138 | 0.345 | −0.238 | 1.510 | 0.379 |
| −1.062 | −0.039 | 0.310 | −0.801 | 0.085 | 0.345 | −1.065 | 0.036 | 0.379 |
| −0.528 | 0.093 | 0.310 | −0.338 | 0.144 | 0.345 | −0.606 | 0.169 | 0.379 |
| −0.790 | 1.464 | 0.310 | 0.046 | 1.398 | 0.345 | −0.148 | 0.164 | 0.379 |
| −0.070 | 0.069 | 0.310 | −0.891 | 1.468 | 0.345 | −0.605 | 1.542 | 0.379 |
| 0.368 | −0.098 | 0.310 | −0.892 | 0.058 | 0.345 | 1.267 | 0.095 | 0.379 |
| 0.822 | −0.425 | 0.310 | 0.452 | −0.121 | 0.345 | 0.800 | 0.781 | 0.379 |
| 1.300 | −0.934 | 0.310 | 0.914 | −0.504 | 0.345 | 0.203 | 0.047 | 0.379 |
| 1.198 | 0.264 | 0.310 | 1.095 | 0.397 | 0.345 | 0.605 | −0.214 | 0.379 |
| 0.748 | 0.861 | 0.310 | 0.651 | 0.958 | 0.345 | 1.083 | −0.695 | 0.379 |
| 0.317 | 1.237 | 0.310 | 0.225 | 1.304 | 0.345 | 0.897 | 0.657 | 0.379 |
| 0.283 | −0.054 | 0.310 | 0.370 | −0.071 | 0.345 | 0.461 | 1.135 | 0.379 |
| 0.719 | −0.336 | 0.310 | 0.816 | −0.409 | 0.345 | 0.115 | 0.086 | 0.379 |
| 1.199 | −0.812 | 0.310 | 1.316 | −0.971 | 0.345 | 0.529 | −0.155 | 0.379 |
| 0.142 | 1.339 | 0.310 | 1.180 | 0.266 | 0.345 | 0.995 | −0.593 | 0.379 |
| 1.306 | 0.092 | 0.310 | 0.735 | 0.868 | 0.345 | 0.988 | 0.530 | 0.379 |
| 0.829 | 0.769 | 0.310 | 0.286 | −0.024 | 0.345 | 0.552 | 1.052 | 0.379 |
| 0.196 | −0.015 | 0.310 | 0.715 | −0.319 | 0.345 | 0.131 | 1.368 | 0.379 |
| 0.611 | −0.253 | 0.310 | 1.184 | −0.805 | 0.345 | 0.452 | −0.099 | 0.379 |
| 1.110 | −0.711 | 0.310 | 1.287 | 0.093 | 0.345 | 0.904 | −0.493 | 0.379 |
| 0.928 | 0.647 | 0.310 | 0.816 | 0.775 | 0.345 | 1.076 | 0.401 | 0.379 |
| 0.480 | 1.116 | 0.310 | 0.393 | 1.190 | 0.345 | 0.639 | 0.965 | 0.379 |
| 0.106 | 0.019 | 0.310 | 0.200 | 0.017 | 0.345 | 0.371 | −0.046 | 0.379 |
| 0.532 | −0.198 | 0.310 | 0.609 | −0.232 | 0.345 | 0.808 | −0.396 | 0.379 |
| 1.018 | −0.613 | 0.310 | 1.097 | −0.702 | 0.345 | 1.298 | −0.967 | 0.379 |
| 1.022 | 0.522 | 0.310 | 0.913 | 0.652 | 0.345 | 1.161 | 0.269 | 0.379 |
| 0.451 | −0.146 | 0.310 | 0.472 | 1.126 | 0.345 | 0.721 | 0.875 | 0.379 |
| 0.922 | −0.517 | 0.310 | 0.111 | 0.054 | 0.345 | 0.302 | 1.261 | 0.379 |
| 1.111 | 0.394 | 0.310 | 0.531 | −0.175 | 0.345 | 0.288 | 0.003 | 0.379 |
| 0.663 | 0.950 | 0.310 | 1.007 | −0.602 | 0.345 | 0.709 | −0.303 | 0.379 |
| 2.198 | −2.291 | 0.310 | 1.006 | 0.526 | 0.345 | 1.169 | −0.799 | 0.379 |
| 2.309 | −2.328 | 0.310 | 2.186 | −2.313 | 0.345 | 2.195 | −2.337 | 0.379 |
| 1.837 | −1.691 | 0.310 | 1.443 | −1.140 | 0.345 | 1.666 | −1.504 | 0.379 |
| 2.393 | −2.230 | 0.310 | 2.308 | −2.322 | 0.345 | 2.319 | −2.287 | 0.379 |
| 2.315 | −2.000 | 0.310 | 2.045 | −2.082 | 0.345 | 2.321 | −2.173 | 0.379 |
| 2.143 | −1.584 | 0.310 | 2.364 | −2.213 | 0.345 | 2.157 | −1.757 | 0.379 |
| 1.699 | −0.623 | 0.310 | 2.253 | −1.921 | 0.345 | 1.828 | −0.994 | 0.379 |
| 2.184 | −2.270 | 0.310 | 2.082 | −1.505 | 0.345 | 1.368 | −0.082 | 0.379 |
| 2.281 | −2.331 | 0.310 | 1.584 | −0.442 | 0.345 | 2.175 | −2.329 | 0.379 |
| 1.713 | −1.500 | 0.310 | 2.170 | −2.297 | 0.345 | 1.542 | −1.313 | 0.379 |
| 2.389 | −2.251 | 0.310 | 2.281 | −2.333 | 0.345 | 2.301 | −2.309 | 0.379 |
| 2.348 | −2.084 | 0.310 | 1.930 | −1.887 | 0.345 | 2.126 | −2.280 | 0.379 |
| 2.178 | −1.666 | 0.310 | 2.365 | −2.235 | 0.345 | 2.329 | −2.195 | 0.379 |
| 1.789 | −0.806 | 0.310 | 2.287 | −2.004 | 0.345 | 2.191 | −1.840 | 0.379 |
| 2.253 | −2.327 | 0.310 | 2.117 | −1.588 | 0.345 | 1.943 | −1.250 | 0.379 |
| 1.586 | −1.313 | 0.310 | 1.676 | −0.624 | 0.345 | 1.466 | −0.261 | 0.379 |
| 2.377 | −2.278 | 0.310 | 2.155 | −2.276 | 0.345 | 2.157 | −2.317 | 0.379 |
| 2.379 | −2.164 | 0.310 | 2.253 | −2.336 | 0.345 | 1.422 | −1.139 | 0.379 |
| 2.212 | 1.749 | 0.310 | 1.812 | −1.694 | 0.345 | 2.278 | −2.326 | 0.379 |
| 1.877 | −0.990 | 0.310 | 2.360 | −2.257 | 0.345 | 2.016 | −2.086 | 0.379 |
| 1.409 | −0.084 | 0.310 | 2.319 | −2.088 | 0.345 | 2.335 | −2.217 | 0.379 |
| 2.233 | −2.319 | 0.310 | 2.151 | −1.671 | 0.345 | 2.224 | −1.923 | 0.379 |
| 1.493 | −1.185 | 0.310 | 1.766 | −0.808 | 0.345 | 2.055 | −1.508 | 0.379 |
| 2.359 | −2.300 | 0.310 | 2.224 | −2.333 | 0.345 | 1.561 | −0.442 | 0.379 |
| 2.072 | −2.077 | 0.310 | 1.690 | −1.502 | 0.345 | 2.140 | −2.301 | 0.379 |
| 2.387 | −2.186 | 0.310 | 2.349 | −2.283 | 0.345 | 2.252 | −2.337 | 0.379 |
| 2.247 | −1.833 | 0.310 | 2.351 | −2.169 | 0.345 | 1.902 | −1.891 | 0.379 |
| 1.994 | −1.244 | 0.310 | 2.186 | −1.754 | 0.345 | 2.335 | −2.239 | 0.379 |
| 1.509 | −0.261 | 0.310 | 1.854 | −0.992 | 0.345 | 2.257 | −2.007 | 0.379 |
| 2.214 | −2.307 | 0.310 | 1.390 | −0.083 | 0.345 | 2.089 | −1.591 | 0.379 |
| 1.398 | −1.058 | 0.310 | 2.205 | −2.325 | 0.345 | 1.653 | −0.625 | 0.379 |
| 2.336 | −2.317 | 0.310 | 1.564 | −1.313 | 0.345 | 2.223 | −2.340 | 0.379 |
| 1.957 | −1.883 | 0.310 | 2.331 | −2.305 | 0.345 | 1.786 | −1.696 | 0.379 |
| 2.392 | −2.208 | 0.310 | 2.359 | −2.192 | 0.345 | 2.331 | −2.260 | 0.379 |
| 2.281 | −1.917 | 0.310 | 2.220 | −1.837 | 0.345 | 2.290 | −2.091 | 0.379 |
| 2.107 | −1.501 | 0.310 | 1.970 | −1.248 | 0.345 | 2.123 | −1.674 | 0.379 |
| 1.605 | −0.441 | 0.310 | 1.488 | −0.262 | 0.345 | 1.742 | −0.809 | 0.379 |

TABLE I-continued

| X | Y | Z' | X | Y | Z' | X | Y | Z' |
|---|---|---|---|---|---|---|---|---|
| −1.806 | −0.236 | 0.414 | −2.229 | 0.005 | 0.448 | −2.149 | 0.427 | 0.483 |
| −2.148 | 0.366 | 0.414 | −2.144 | −0.155 | 0.448 | −2.226 | 0.150 | 0.483 |
| −2.233 | 0.089 | 0.414 | −1.947 | −0.216 | 0.448 | −2.201 | −0.034 | 0.483 |
| −2.219 | −0.099 | 0.414 | −2.022 | 0.637 | 0.448 | −2.061 | −0.154 | 0.483 |
| −2.089 | −0.230 | 0.414 | −2.192 | 0.279 | 0.448 | −1.830 | −0.159 | 0.483 |
| −1.857 | −0.246 | 0.414 | −2.232 | 0.043 | 0.448 | −1.846 | 0.929 | 0.483 |
| −1.838 | 0.867 | 0.414 | −2.172 | −0.129 | 0.448 | −2.124 | 0.484 | 0.483 |
| −2.122 | 0.423 | 0.414 | −1.997 | −0.213 | 0.448 | −2.221 | 0.188 | 0.483 |
| −2.226 | 0.128 | 0.414 | −1.965 | 0.726 | 0.448 | −2.214 | 0.000 | 0.483 |
| −2.230 | −0.063 | 0.414 | −2.172 | 0.338 | 0.448 | −2.097 | −0.138 | 0.483 |
| −2.124 | −0.212 | 0.414 | −2.232 | 0.081 | 0.448 | −1.881 | −0.168 | 0.483 |
| −1.909 | −0.253 | 0.414 | −2.194 | −0.100 | 0.448 | −2.077 | 0.578 | 0.483 |
| −2.073 | 0.516 | 0.414 | −2.037 | −0.205 | 0.448 | −2.208 | 0.249 | 0.483 |
| −2.212 | 0.189 | 0.414 | −1.793 | −0.193 | 0.448 | −2.223 | 0.037 | 0.483 |
| −2.236 | −0.026 | 0.414 | −1.905 | 0.813 | 0.448 | −2.131 | −0.118 | 0.483 |
| −2.156 | −0.189 | 0.414 | −2.148 | 0.396 | 0.448 | −1.932 | −0.172 | 0.483 |
| −1.960 | −0.255 | 0.414 | −2.229 | 0.119 | 0.448 | −2.024 | 0.669 | 0.483 |
| −2.020 | 0.607 | 0.414 | −2.210 | −0.067 | 0.448 | −2.192 | 0.310 | 0.483 |
| −2.194 | 0.249 | 0.414 | −2.076 | −0.193 | 0.448 | −2.227 | 0.074 | 0.483 |
| −2.238 | 0.013 | 0.414 | −1.844 | −0.205 | 0.448 | −2.160 | −0.093 | 0.483 |
| −2.183 | −0.162 | 0.414 | −2.122 | 0.453 | 0.448 | −1.983 | −0.170 | 0.483 |
| −2.011 | −0.251 | 0.414 | −2.223 | 0.158 | 0.448 | −1.968 | 0.758 | 0.483 |
| −1.963 | 0.696 | 0.414 | −2.222 | −0.032 | 0.448 | −2.172 | 0.369 | 0.483 |
| −2.172 | 0.308 | 0.414 | −2.112 | −0.177 | 0.448 | −2.228 | 0.112 | 0.483 |
| −2.237 | 0.051 | 0.414 | −1.895 | −0.213 | 0.448 | −2.182 | −0.065 | 0.483 |
| −2.204 | −0.132 | 0.414 | −1.775 | 0.979 | 0.448 | −2.022 | −0.164 | 0.483 |
| −2.051 | −0.243 | 0.414 | −2.074 | 0.546 | 0.448 | −1.779 | −0.146 | 0.483 |
| −1.434 | −0.091 | 0.414 | −2.210 | 0.218 | 0.448 | −1.909 | 0.845 | 0.483 |
| −1.536 | 1.183 | 0.414 | −1.643 | −0.144 | 0.448 | −1.484 | −0.029 | 0.483 |
| −1.507 | −0.126 | 0.414 | −1.278 | 1.400 | 0.448 | −1.557 | −0.063 | 0.483 |
| −1.581 | −0.158 | 0.414 | −1.717 | −0.171 | 0.448 | −1.371 | 1.378 | 0.483 |
| −1.359 | 1.316 | 0.414 | −1.280 | 0.024 | 0.448 | −1.630 | −0.095 | 0.483 |
| −1.655 | −0.188 | 0.414 | −1.623 | 1.140 | 0.448 | −1.706 | 1.093 | 0.483 |
| −1.696 | 1.030 | 0.414 | −1.423 | −0.045 | 0.448 | −1.704 | −0.123 | 0.483 |
| −1.730 | −0.214 | 0.414 | −1.496 | −0.080 | 0.448 | −1.269 | 0.076 | 0.483 |
| −1.290 | −0.023 | 0.414 | −1.455 | 1.283 | 0.448 | −1.195 | 1.477 | 0.483 |
| −0.878 | 0.146 | 0.414 | −1.569 | −0.113 | 0.448 | −1.412 | 0.006 | 0.483 |
| −0.610 | 1.566 | 0.414 | −1.136 | 0.091 | 0.448 | −1.547 | 1.246 | 0.483 |
| −0.435 | 0.227 | 0.414 | −0.341 | 1.566 | 0.448 | −0.077 | 1.495 | 0.483 |
| −0.031 | 0.171 | 0.414 | −0.683 | 0.241 | 0.448 | −0.948 | 0.213 | 0.483 |
| −0.060 | 1.468 | 0.414 | −0.262 | 0.256 | 0.448 | −0.496 | 0.306 | 0.483 |
| −0.968 | 0.115 | 0.414 | −0.777 | 0.220 | 0.448 | −1.008 | 1.551 | 0.483 |
| −0.517 | 0.222 | 0.414 | −0.708 | 1.584 | 0.448 | −0.094 | 0.252 | 0.483 |
| −0.997 | 1.494 | 0.414 | −0.344 | 0.265 | 0.448 | −1.037 | 0.179 | 0.483 |
| −0.109 | 0.192 | 0.414 | 0.050 | 0.172 | 0.448 | −0.438 | 1.599 | 0.483 |
| −1.057 | 0.080 | 0.414 | −0.162 | 1.518 | 0.448 | −0.578 | 0.300 | 0.483 |
| −0.426 | 1.560 | 0.414 | −0.868 | 0.193 | 0.448 | −0.171 | 0.274 | 0.483 |
| −0.599 | 0.213 | 0.414 | −0.426 | 0.267 | 0.448 | −1.125 | 0.143 | 0.483 |
| −0.188 | 0.209 | 0.414 | −1.097 | 1.488 | 0.448 | −0.672 | 0.287 | 0.483 |
| −1.145 | 0.043 | 0.414 | −0.025 | 0.200 | 0.448 | −0.813 | 1.596 | 0.483 |
| −0.693 | 0.196 | 0.414 | −0.959 | 0.162 | 0.448 | −0.252 | 0.290 | 0.483 |
| −0.802 | 1.545 | 0.414 | −0.524 | 1.588 | 0.448 | −0.258 | 1.561 | 0.483 |
| −0.270 | 0.220 | 0.414 | −0.508 | 0.265 | 0.448 | −0.765 | 0.268 | 0.483 |
| −0.244 | 1.528 | 0.414 | −0.102 | 0.224 | 0.448 | −0.333 | 0.301 | 0.483 |
| −0.786 | 0.174 | 0.414 | 0.024 | 1.440 | 0.448 | 0.056 | 0.195 | 0.483 |
| −0.352 | 0.226 | 0.414 | −1.048 | 0.128 | 0.448 | −0.857 | 0.242 | 0.483 |
| −1.184 | 1.417 | 0.414 | −0.589 | 0.257 | 0.448 | −0.622 | 1.611 | 0.483 |
| 0.045 | 0.145 | 0.414 | −0.906 | 1.550 | 0.448 | −0.415 | 0.306 | 0.483 |
| 0.705 | 0.880 | 0.414 | −0.180 | 0.243 | 0.448 | −0.018 | 0.226 | 0.483 |
| 0.292 | 1.271 | 0.414 | 0.949 | 0.537 | 0.448 | 1.238 | −0.960 | 0.483 |
| 0.371 | −0.025 | 0.414 | 0.524 | 1.065 | 0.448 | 0.745 | 0.792 | 0.483 |
| 0.799 | −0.385 | 0.414 | 0.123 | 0.139 | 0.448 | 0.345 | 1.222 | 0.483 |
| 1.279 | −0.964 | 0.414 | 0.522 | −0.124 | 0.448 | 0.292 | 0.063 | 0.483 |
| 1.262 | 0.067 | 0.414 | 0.967 | −0.579 | 0.448 | 0.685 | −0.272 | 0.483 |
| 0.784 | 0.786 | 0.414 | 1.035 | 0.406 | 0.448 | 1.115 | −0.788 | 0.483 |
| 0.372 | 1.209 | 0.414 | 0.608 | 0.977 | 0.448 | 0.838 | 0.667 | 0.483 |
| 0.290 | 0.026 | 0.414 | 0.198 | 1.338 | 0.448 | 0.420 | 1.155 | 0.483 |
| 0.702 | −0.290 | 0.414 | 0.448 | −0.064 | 0.448 | 0.211 | 0.114 | 0.483 |
| 1.152 | −0.795 | 0.414 | 0.880 | −0.476 | 0.448 | 0.588 | −0.177 | 0.483 |
| 0.879 | 0.661 | 0.414 | 1.118 | 0.273 | 0.448 | 1.035 | −0.680 | 0.483 |
| 0.449 | 1.143 | 0.414 | 0.688 | 0.885 | 0.448 | 0.927 | 0.538 | 0.483 |
| 0.206 | 0.073 | 0.414 | 0.280 | 1.279 | 0.448 | 0.507 | 1.069 | 0.483 |
| 0.600 | −0.199 | 0.414 | 0.371 | −0.007 | 0.448 | 0.102 | 1.401 | 0.483 |
| 1.068 | −0.689 | 0.414 | 0.789 | −0.376 | 0.448 | 0.128 | 0.160 | 0.483 |
| 0.969 | 0.534 | 0.414 | 1.259 | −0.962 | 0.448 | 0.518 | −0.113 | 0.483 |
| 0.539 | 1.060 | 0.414 | 1.239 | 0.068 | 0.448 | 0.952 | −0.574 | 0.483 |
| 0.122 | 1.381 | 0.414 | 0.765 | 0.790 | 0.448 | 1.012 | 0.407 | 0.483 |

TABLE I-continued

| X | Y | Z' | X | Y | Z' | X | Y | Z' |
|---|---|---|---|---|---|---|---|---|
| 0.119 | 0.114 | 0.414 | 0.359 | 1.216 | 0.448 | 0.590 | 0.980 | 0.483 |
| 0.526 | −0.138 | 0.414 | 0.291 | 0.047 | 0.448 | 1.214 | 0.069 | 0.483 |
| 0.982 | −0.585 | 0.414 | 0.694 | −0.279 | 0.448 | 0.445 | −0.051 | 0.483 |
| 1.056 | 0.403 | 0.414 | 1.134 | −0.791 | 0.448 | 0.867 | −0.471 | 0.483 |
| 0.624 | 0.972 | 0.414 | 0.859 | 0.665 | 0.448 | 1.094 | 0.274 | 0.483 |
| 0.450 | −0.080 | 0.414 | 0.435 | 1.150 | 0.448 | 0.669 | 0.887 | 0.483 |
| 0.892 | −0.483 | 0.414 | 0.208 | 0.095 | 0.448 | 0.267 | 1.286 | 0.483 |
| 1.140 | 0.271 | 0.414 | 0.595 | −0.186 | 0.448 | 0.370 | 0.008 | 0.483 |
| 2.165 | −2.339 | 0.414 | 1.052 | −0.684 | 0.448 | 0.778 | −0.370 | 0.483 |
| 2.288 | −2.289 | 0.414 | 1.997 | −1.510 | 0.448 | 2.064 | −2.318 | 0.483 |
| 2.290 | −2.175 | 0.414 | 1.465 | −0.350 | 0.448 | 2.185 | −2.326 | 0.483 |
| 2.128 | −1.758 | 0.414 | 2.273 | −2.241 | 0.448 | 1.897 | −2.039 | 0.483 |
| 1.874 | −1.893 | 0.414 | 2.196 | −2.008 | 0.448 | 2.241 | −2.216 | 0.483 |
| 1.802 | −0.995 | 0.414 | 2.031 | −1.593 | 0.448 | 2.132 | −1.922 | 0.483 |
| 2.221 | −2.339 | 0.414 | 2.114 | −2.332 | 0.448 | 2.100 | −1.839 | 0.483 |
| 2.304 | −2.241 | 0.414 | 1.494 | −1.313 | 0.448 | 1.858 | −1.250 | 0.483 |
| 2.161 | −1.841 | 0.414 | 2.239 | −2.311 | 0.448 | 1.329 | −0.139 | 0.483 |
| 1.759 | −1.698 | 0.414 | 1.571 | −0.563 | 0.448 | 2.048 | −2.302 | 0.483 |
| 1.916 | −1.251 | 0.414 | 2.267 | −2.197 | 0.448 | 2.159 | −2.337 | 0.483 |
| 1.378 | −0.141 | 0.414 | 2.131 | −1.841 | 0.448 | 1.759 | −1.796 | 0.483 |
| 2.110 | −2.303 | 0.414 | 2.095 | −2.320 | 0.448 | 2.242 | −2.238 | 0.483 |
| 2.271 | −2.311 | 0.414 | 1.378 | −1.136 | 0.448 | 2.165 | −2.006 | 0.483 |
| 2.194 | −1.925 | 0.414 | 2.217 | −2.328 | 0.448 | 2.034 | −1.674 | 0.483 |
| 1.641 | −1.504 | 0.414 | 1.674 | −0.778 | 0.448 | 1.647 | −0.777 | 0.483 |
| 2.026 | −1.510 | 0.414 | 2.269 | −2.262 | 0.448 | 2.131 | −2.340 | 0.483 |
| 1.490 | −0.351 | 0.414 | 2.228 | −2.093 | 0.448 | 1.617 | −1.553 | 0.483 |
| 2.126 | −2.319 | 0.414 | 2.065 | −1.675 | 0.448 | 2.237 | −2.260 | 0.483 |
| 2.193 | −2.343 | 0.414 | 2.079 | −2.304 | 0.448 | 2.197 | −2.090 | 0.483 |
| 2.300 | −2.262 | 0.414 | 2.190 | −2.339 | 0.448 | 1.967 | −1.509 | 0.483 |
| 2.096 | −2.283 | 0.414 | 1.928 | −2.040 | 0.448 | 1.439 | −0.350 | 0.483 |
| 2.227 | −2.008 | 0.414 | 1.774 | −0.994 | 0.448 | 2.103 | −2.337 | 0.483 |
| 1.519 | −1.313 | 0.414 | 2.273 | −2.219 | 0.448 | 1.469 | −1.312 | 0.483 |
| 2.061 | −1.592 | 0.414 | 2.163 | −1.924 | 0.448 | 2.226 | −2.286 | 0.483 |
| 2.145 | −2.331 | 0.414 | 2.065 | −2.283 | 0.448 | 2.228 | −2.172 | 0.483 |
| 1.597 | −0.564 | 0.414 | 2.162 | −2.343 | 0.448 | 2.067 | −1.757 | 0.483 |
| 2.248 | −2.328 | 0.414 | 1.788 | −1.796 | 0.448 | 1.746 | −0.993 | 0.483 |
| 2.299 | −2.197 | 0.414 | 1.887 | −1.251 | 0.448 | 2.083 | −2.329 | 0.483 |
| 2.304 | −2.219 | 0.414 | 1.354 | −0.140 | 0.448 | 1.355 | −1.135 | 0.483 |
| 2.259 | −2.093 | 0.414 | 2.257 | −2.289 | 0.448 | 2.208 | −2.309 | 0.483 |
| 1.401 | −1.137 | 0.414 | 2.259 | −2.175 | 0.448 | 2.034 | −2.281 | 0.483 |
| 2.094 | −1.675 | 0.414 | 2.098 | −1.758 | 0.448 | 2.236 | −2.195 | 0.483 |
| 1.986 | −2.088 | 0.414 | 2.134 | −2.339 | 0.448 | 2.001 | −1.591 | 0.483 |
| 1.701 | −0.778 | 0.414 | 1.644 | −1.553 | 0.448 | 1.544 | −0.562 | 0.483 |
| −1.712 | 1.126 | 0.517 | −1.791 | 1.078 | 0.552 | −1.924 | 0.948 | 0.586 |
| −2.028 | 0.701 | 0.517 | −2.082 | 0.643 | 0.552 | −2.153 | 0.529 | 0.586 |
| −2.191 | 0.341 | 0.517 | −2.205 | 0.314 | 0.552 | −2.214 | 0.251 | 0.586 |
| −2.221 | 0.106 | 0.517 | −2.200 | 0.083 | 0.552 | −2.165 | 0.077 | 0.586 |
| −2.146 | −0.056 | 0.517 | −2.068 | −0.052 | 0.552 | −2.015 | −0.014 | 0.586 |
| −1.966 | −0.125 | 0.517 | −1.864 | −0.068 | 0.552 | −1.788 | 0.005 | 0.586 |
| −1.681 | −0.066 | 0.517 | −2.032 | 0.735 | 0.552 | −1.862 | 1.032 | 0.586 |
| −1.972 | 0.791 | 0.517 | −2.190 | 0.374 | 0.552 | −2.130 | 0.586 | 0.586 |
| −2.172 | 0.401 | 0.517 | −2.212 | 0.124 | 0.552 | −2.212 | 0.289 | 0.586 |
| −2.223 | 0.144 | 0.517 | −2.101 | −0.037 | 0.552 | −2.184 | 0.107 | 0.586 |
| −2.170 | −0.030 | 0.517 | −1.923 | −0.074 | 0.552 | −2.050 | −0.005 | 0.586 |
| −2.006 | −0.120 | 0.517 | −1.668 | 1.213 | 0.552 | −1.846 | −0.010 | 0.586 |
| −1.764 | −0.095 | 0.517 | −1.977 | 0.824 | 0.552 | −2.086 | 0.680 | 0.586 |
| −1.914 | 0.878 | 0.517 | −2.172 | 0.434 | 0.552 | −2.204 | 0.350 | 0.586 |
| −2.150 | 0.459 | 0.517 | −2.217 | 0.166 | 0.552 | −2.198 | 0.141 | 0.586 |
| −2.222 | 0.182 | 0.517 | −2.130 | −0.017 | 0.552 | −2.084 | 0.009 | 0.586 |
| −2.190 | 0.001 | 0.517 | −1.961 | −0.075 | 0.552 | −1.905 | −0.019 | 0.586 |
| −2.045 | −0.111 | 0.517 | −1.665 | −0.008 | 0.552 | −1.737 | 1.183 | 0.586 |
| −1.814 | −0.108 | 0.517 | −1.919 | 0.911 | 0.552 | −2.035 | 0.772 | 0.586 |
| −1.851 | 0.962 | 0.517 | −2.151 | 0.492 | 0.552 | −2.190 | 0.410 | 0.586 |
| −2.125 | 0.516 | 0.517 | −2.218 | 0.209 | 0.552 | −2.207 | 0.176 | 0.586 |
| −2.218 | 0.220 | 0.517 | −2.159 | 0.012 | 0.552 | −2.114 | 0.027 | 0.586 |
| −2.205 | 0.034 | 0.517 | −1.998 | −0.071 | 0.552 | −1.942 | −0.021 | 0.586 |
| −2.081 | −0.098 | 0.517 | −1.747 | −0.038 | 0.552 | −1.981 | 0.861 | 0.586 |
| −1.865 | −0.119 | 0.517 | −1.857 | 0.996 | 0.552 | −2.173 | 0.470 | 0.586 |
| −2.079 | 0.610 | 0.517 | −2.128 | 0.550 | 0.552 | −2.212 | 0.213 | 0.586 |
| −2.207 | 0.281 | 0.517 | −2.215 | 0.253 | 0.552 | −2.142 | 0.050 | 0.586 |
| −2.215 | 0.069 | 0.517 | −2.183 | 0.046 | 0.552 | −1.979 | −0.019 | 0.586 |
| −2.115 | −0.079 | 0.517 | −2.034 | −0.064 | 0.552 | −1.730 | 0.024 | 0.586 |
| −1.915 | −0.124 | 0.517 | −1.805 | −0.055 | 0.552 | −1.607 | 1.311 | 0.586 |
| −1.277 | 0.123 | 0.517 | −1.504 | 0.065 | 0.552 | −1.364 | 0.194 | 0.586 |
| −1.224 | 1.496 | 0.517 | −1.099 | 0.258 | 0.552 | −1.155 | 1.593 | 0.586 |
| −1.358 | 0.084 | 0.517 | −1.383 | 1.443 | 0.552 | −1.455 | 0.148 | 0.586 |
| −1.554 | 1.278 | 0.517 | −1.584 | 0.027 | 0.552 | −1.465 | 1.425 | 0.586 |

TABLE I-continued

| X | Y | Z' | X | Y | Z' | X | Y | Z' |
|---|---|---|---|---|---|---|---|---|
| −1.438 | 0.044 | 0.517 | −1.182 | 0.223 | 0.552 | −1.546 | 0.103 | 0.586 |
| −1.518 | 0.004 | 0.517 | −1.263 | 0.185 | 0.552 | −1.638 | 0.061 | 0.586 |
| −1.113 | 0.198 | 0.517 | −1.230 | 1.527 | 0.552 | −1.179 | 0.282 | 0.586 |
| −1.377 | 1.410 | 0.517 | −1.344 | 0.145 | 0.552 | −1.313 | 1.520 | 0.586 |
| −1.599 | −0.033 | 0.517 | −1.532 | 1.335 | 0.552 | −1.272 | 0.239 | 0.586 |
| −1.195 | 0.162 | 0.517 | −1.424 | 0.105 | 0.552 | −0.852 | 0.395 | 0.586 |
| −0.354 | 1.599 | 0.517 | −1.068 | 1.592 | 0.552 | −0.449 | 0.425 | 0.586 |
| −0.844 | 0.294 | 0.517 | −0.226 | 0.349 | 0.552 | −0.063 | 0.316 | 0.586 |
| −0.401 | 0.344 | 0.517 | −0.542 | 1.646 | 0.552 | −0.458 | 1.648 | 0.586 |
| −0.010 | 0.248 | 0.517 | −0.709 | 0.373 | 0.552 | −0.931 | 0.374 | 0.586 |
| −0.935 | 0.266 | 0.517 | −0.188 | 1.555 | 0.552 | −0.530 | 0.430 | 0.586 |
| −0.720 | 1.631 | 0.517 | −0.305 | 0.367 | 0.552 | −0.136 | 0.347 | 0.586 |
| −0.482 | 0.347 | 0.517 | 0.070 | 0.230 | 0.552 | −0.988 | 1.644 | 0.586 |
| −0.084 | 0.277 | 0.517 | −0.789 | 0.358 | 0.552 | 0.063 | 1.415 | 0.586 |
| −0.179 | 1.544 | 0.517 | −0.899 | 1.635 | 0.552 | −1.008 | 0.349 | 0.586 |
| −1.025 | 0.234 | 0.517 | −0.385 | 0.380 | 0.552 | −0.639 | 1.673 | 0.586 |
| −0.563 | 0.344 | 0.517 | 0.000 | 0.266 | 0.552 | −0.611 | 0.429 | 0.586 |
| −1.062 | 1.563 | 0.517 | −0.362 | 1.613 | 0.552 | −0.212 | 0.374 | 0.586 |
| −0.160 | 0.301 | 0.517 | −0.868 | 0.338 | 0.552 | −1.084 | 0.321 | 0.586 |
| −0.536 | 1.628 | 0.517 | −0.466 | 0.386 | 0.552 | −0.692 | 0.423 | 0.586 |
| −0.658 | 0.334 | 0.517 | −0.073 | 0.298 | 0.552 | −0.817 | 1.671 | 0.586 |
| −0.240 | 0.321 | 0.517 | −0.946 | 0.315 | 0.552 | −0.290 | 0.397 | 0.586 |
| 0.003 | 1.459 | 0.517 | −0.725 | 1.653 | 0.552 | −0.107 | 1.519 | 0.586 |
| −0.752 | 0.317 | 0.517 | −0.547 | 0.388 | 0.552 | −0.772 | 0.411 | 0.586 |
| −0.893 | 1.609 | 0.517 | −0.148 | 0.326 | 0.552 | −0.369 | 0.413 | 0.586 |
| −0.320 | 0.335 | 0.517 | −1.023 | 0.288 | 0.552 | 0.008 | 0.281 | 0.586 |
| 0.063 | 0.215 | 0.517 | −0.008 | 1.465 | 0.552 | −0.282 | 1.597 | 0.586 |
| 0.442 | −0.043 | 0.517 | −0.628 | 0.383 | 0.552 | 0.718 | 0.733 | 0.586 |
| 0.903 | −0.530 | 0.517 | 0.139 | 0.190 | 0.552 | 0.296 | 1.225 | 0.586 |
| 1.070 | 0.274 | 0.517 | 0.574 | −0.168 | 0.552 | 0.322 | 0.064 | 0.586 |
| 0.649 | 0.888 | 0.517 | 1.076 | −0.785 | 0.552 | 0.772 | −0.405 | 0.586 |
| 0.369 | 0.018 | 0.517 | 0.628 | 0.886 | 0.552 | 0.796 | 0.621 | 0.586 |
| 0.801 | −0.406 | 0.517 | 0.314 | 1.226 | 0.552 | 0.368 | 1.155 | 0.586 |
| 0.173 | 1.351 | 0.517 | 0.879 | 0.536 | 0.552 | 0.234 | 0.134 | 0.586 |
| 0.988 | 0.407 | 0.517 | 0.494 | −0.089 | 0.552 | 0.671 | −0.284 | 0.586 |
| 0.489 | 1.071 | 0.517 | 0.983 | −0.656 | 0.552 | 0.872 | 0.506 | 0.586 |
| 0.404 | 1.157 | 0.517 | 0.471 | 1.070 | 0.552 | 0.462 | 1.055 | 0.586 |
| 0.293 | 0.075 | 0.517 | 0.963 | 0.406 | 0.552 | 0.143 | 0.199 | 0.586 |
| 0.694 | −0.286 | 0.517 | 0.410 | −0.013 | 0.552 | 0.565 | −0.167 | 0.586 |
| 0.253 | 1.290 | 0.517 | 0.887 | −0.529 | 0.552 | 1.055 | −0.785 | 0.586 |
| 0.724 | 0.792 | 0.517 | 0.238 | 1.292 | 0.552 | 0.945 | 0.389 | 0.586 |
| 0.214 | 0.128 | 0.517 | 1.044 | 0.273 | 0.552 | 0.551 | 0.951 | 0.586 |
| 0.581 | −0.171 | 0.517 | 0.324 | 0.060 | 0.552 | 0.144 | 1.356 | 0.586 |
| 1.096 | −0.786 | 0.517 | 0.788 | −0.405 | 0.552 | 0.076 | 0.242 | 0.586 |
| 0.330 | 1.225 | 0.517 | 0.551 | 0.979 | 0.552 | 0.487 | −0.087 | 0.586 |
| 0.903 | 0.538 | 0.517 | 0.159 | 1.354 | 0.552 | 0.964 | −0.656 | 0.586 |
| 0.571 | 0.981 | 0.517 | 0.702 | 0.790 | 0.552 | 1.017 | 0.271 | 0.586 |
| 0.133 | 0.177 | 0.517 | 0.233 | 0.127 | 0.552 | 0.636 | 0.844 | 0.586 |
| 0.513 | −0.106 | 0.517 | 0.683 | −0.285 | 0.552 | 0.222 | 1.292 | 0.586 |
| 1.001 | −0.657 | 0.517 | 0.386 | 1.157 | 0.552 | 0.406 | −0.010 | 0.586 |
| 0.816 | 0.667 | 0.517 | 0.793 | 0.665 | 0.552 | 0.870 | −0.529 | 0.586 |
| 2.051 | −2.324 | 0.517 | 1.986 | −2.289 | 0.552 | 1.134 | 0.068 | 0.586 |
| 1.444 | −1.311 | 0.517 | 2.096 | −2.323 | 0.552 | 1.970 | −2.294 | 0.586 |
| 2.176 | −2.304 | 0.517 | 1.701 | −1.789 | 0.552 | 1.283 | −1.130 | 0.586 |
| 2.204 | −2.190 | 0.517 | 2.179 | −2.225 | 0.552 | 2.090 | −2.301 | 0.586 |
| 2.102 | −1.919 | 0.517 | 2.119 | −2.037 | 0.552 | 2.146 | −2.193 | 0.586 |
| 1.716 | −0.991 | 0.517 | 1.906 | −1.501 | 0.552 | 2.063 | −1.966 | 0.586 |
| 2.033 | −2.313 | 0.517 | 1.383 | −0.348 | 0.552 | 1.768 | −1.239 | 0.586 |
| 1.332 | −1.133 | 0.517 | 2.068 | −2.327 | 0.552 | 1.246 | −0.138 | 0.586 |
| 2.154 | −2.321 | 0.517 | 1.562 | −1.548 | 0.552 | 1.954 | −2.279 | 0.586 |
| 2.210 | −2.211 | 0.517 | 2.174 | −2.247 | 0.552 | 1.171 | −0.956 | 0.586 |
| 2.126 | −1.981 | 0.517 | 2.142 | −2.100 | 0.552 | 2.064 | −2.312 | 0.586 |
| 1.411 | −0.349 | 0.517 | 2.023 | −1.790 | 0.552 | 1.806 | −2.022 | 0.586 |
| 1.829 | −1.248 | 0.517 | 1.488 | −0.560 | 0.552 | 2.147 | −2.215 | 0.586 |
| 2.017 | −2.297 | 0.517 | 2.040 | −2.324 | 0.552 | 2.087 | −2.028 | 0.586 |
| 1.216 | −0.958 | 0.517 | 1.419 | −1.309 | 0.552 | 1.875 | −1.495 | 0.586 |
| 2.128 | −2.331 | 0.517 | 2.162 | −2.273 | 0.552 | 1.354 | −0.347 | 0.586 |
| 1.867 | −2.036 | 0.517 | 2.165 | −2.160 | 0.552 | 1.940 | −2.259 | 0.586 |
| 2.210 | −2.233 | 0.517 | 2.047 | −1.851 | 0.552 | 2.036 | −2.316 | 0.586 |
| 2.150 | −2.044 | 0.517 | 1.589 | −0.773 | 0.552 | 1.671 | −1.783 | 0.586 |
| 1.937 | −1.506 | 0.517 | 2.020 | −2.316 | 0.552 | 2.142 | −2.236 | 0.586 |
| 1.189 | 0.070 | 0.517 | 1.308 | −1.132 | 0.552 | 2.111 | −2.091 | 0.586 |
| 2.002 | −2.277 | 0.517 | 2.145 | −2.295 | 0.552 | 1.991 | −1.782 | 0.586 |
| 2.099 | −2.335 | 0.517 | 1.971 | −2.269 | 0.552 | 1.458 | −0.558 | 0.586 |
| 1.730 | −1.793 | 0.517 | 2.173 | −2.182 | 0.552 | 2.009 | −2.313 | 0.586 |
| 2.206 | −2.255 | 0.517 | 2.071 | −1.913 | 0.552 | 1.534 | −1.543 | 0.586 |
| 2.173 | −2.107 | 0.517 | 1.687 | −0.989 | 0.552 | 2.130 | −2.262 | 0.586 |

TABLE I-continued

| X | Y | Z' | X | Y | Z' | X | Y | Z' |
|---|---|---|---|---|---|---|---|---|
| 1.516 | −0.561 | 0.517 | 1.162 | 0.069 | 0.552 | 2.134 | −2.151 | 0.586 |
| 2.054 | −1.796 | 0.517 | 2.002 | −2.305 | 0.552 | 2.016 | −1.843 | 0.586 |
| 2.071 | −2.332 | 0.517 | 1.194 | −0.957 | 0.552 | 1.559 | −0.770 | 0.586 |
| 1.589 | −1.551 | 0.517 | 2.122 | −2.312 | 0.552 | 1.989 | −2.305 | 0.586 |
| 2.194 | −2.281 | 0.517 | 1.837 | −2.030 | 0.552 | 1.392 | −1.305 | 0.586 |
| 2.196 | −2.168 | 0.517 | 2.178 | −2.203 | 0.552 | 2.113 | −2.285 | 0.586 |
| 2.078 | −1.857 | 0.517 | 2.095 | −1.975 | 0.552 | 2.141 | −2.172 | 0.586 |
| 1.302 | −0.138 | 0.517 | 1.798 | −1.244 | 0.552 | 2.039 | −1.904 | 0.586 |
| 1.618 | −0.775 | 0.517 | 1.275 | −0.138 | 0.552 | 1.656 | −0.985 | 0.586 |
| −1.715 | 0.091 | 0.621 | −2.019 | 0.109 | 0.655 | −2.207 | 0.394 | 0.690 |
| −1.962 | 0.939 | 0.621 | −1.815 | 0.123 | 0.655 | −2.134 | 0.236 | 0.690 |
| −2.155 | 0.570 | 0.621 | −1.806 | 1.195 | 0.655 | −1.949 | 0.173 | 0.690 |
| −2.211 | 0.292 | 0.621 | −2.058 | 0.832 | 0.655 | −1.691 | 0.237 | 0.690 |
| −2.153 | 0.123 | 0.621 | −2.100 | 0.754 | 0.655 | −1.969 | 1.033 | 0.690 |
| −1.998 | 0.042 | 0.621 | −2.204 | 0.438 | 0.655 | −2.159 | 0.678 | 0.690 |
| −1.772 | 0.071 | 0.621 | −2.183 | 0.234 | 0.655 | −2.209 | 0.431 | 0.690 |
| −1.911 | 1.012 | 0.621 | −2.053 | 0.119 | 0.655 | −2.158 | 0.262 | 0.690 |
| −2.133 | 0.627 | 0.621 | −1.872 | 0.110 | 0.655 | −1.993 | 0.175 | 0.690 |
| −2.210 | 0.330 | 0.621 | −1.915 | 1.056 | 0.655 | −1.747 | 0.216 | 0.690 |
| −2.174 | 0.152 | 0.621 | −2.192 | 0.498 | 0.655 | −1.918 | 1.105 | 0.690 |
| −2.034 | 0.049 | 0.621 | −2.196 | 0.268 | 0.655 | −2.141 | 0.726 | 0.690 |
| −1.829 | 0.054 | 0.621 | −2.086 | 0.133 | 0.655 | −2.206 | 0.481 | 0.690 |
| −1.858 | 1.084 | 0.621 | −1.909 | 0.105 | 0.655 | −2.177 | 0.291 | 0.690 |
| −2.096 | 0.708 | 0.621 | −2.013 | 0.909 | 0.655 | −2.035 | 0.182 | 0.690 |
| −2.203 | 0.391 | 0.621 | −2.177 | 0.558 | 0.655 | −1.803 | 0.197 | 0.690 |
| −2.190 | 0.184 | 0.621 | −2.204 | 0.303 | 0.655 | −1.864 | 1.174 | 0.690 |
| −2.067 | 0.060 | 0.621 | −2.116 | 0.152 | 0.655 | −2.104 | 0.806 | 0.690 |
| −1.887 | 0.043 | 0.621 | −1.946 | 0.103 | 0.655 | −2.199 | 0.532 | 0.690 |
| −2.054 | 0.786 | 0.621 | −1.702 | 0.162 | 0.655 | −2.192 | 0.324 | 0.690 |
| −2.191 | 0.451 | 0.621 | −1.681 | 1.327 | 0.655 | −2.075 | 0.197 | 0.690 |
| −2.201 | 0.219 | 0.621 | −2.159 | 0.616 | 0.655 | −1.861 | 0.183 | 0.690 |
| −2.099 | 0.076 | 0.621 | −2.208 | 0.340 | 0.655 | −2.062 | 0.883 | 0.690 |
| −1.924 | 0.039 | 0.621 | −2.143 | 0.176 | 0.655 | −2.189 | 0.581 | 0.690 |
| −1.742 | 1.221 | 0.621 | −1.983 | 0.104 | 0.655 | −2.202 | 0.358 | 0.690 |
| −1.259 | 0.307 | 0.621 | −1.758 | 0.141 | 0.655 | −2.106 | 0.214 | 0.690 |
| −1.351 | 0.263 | 0.621 | −1.966 | 0.984 | 0.655 | −1.905 | 0.176 | 0.690 |
| −1.612 | 1.349 | 0.621 | −2.136 | 0.674 | 0.655 | −1.747 | 1.307 | 0.690 |
| −1.442 | 0.217 | 0.621 | −2.209 | 0.377 | 0.655 | −2.017 | 0.959 | 0.690 |
| −1.158 | 1.623 | 0.621 | −2.165 | 0.203 | 0.655 | −2.175 | 0.630 | 0.690 |
| −1.533 | 0.172 | 0.621 | −1.394 | 1.546 | 0.655 | −1.237 | 0.445 | 0.690 |
| −1.317 | 1.553 | 0.621 | −1.430 | 0.289 | 0.655 | −1.317 | 1.623 | 0.690 |
| −1.623 | 0.129 | 0.621 | −1.521 | 0.244 | 0.655 | −1.330 | 0.405 | 0.690 |
| −1.166 | 0.348 | 0.621 | −1.611 | 0.202 | 0.655 | −1.615 | 1.430 | 0.690 |
| −1.469 | 1.461 | 0.621 | −1.153 | 0.415 | 0.655 | −1.421 | 0.362 | 0.690 |
| −2.009 | 0.864 | 0.621 | −1.545 | 1.445 | 0.655 | −1.158 | 1.686 | 0.690 |
| −2.175 | 0.511 | 0.621 | −1.247 | 0.376 | 0.655 | −1.511 | 0.319 | 0.690 |
| −2.208 | 0.255 | 0.621 | −1.240 | 1.624 | 0.655 | −1.471 | 1.537 | 0.690 |
| −2.128 | 0.097 | 0.621 | −1.340 | 0.333 | 0.655 | −1.601 | 0.277 | 0.690 |
| −1.962 | 0.039 | 0.621 | −0.981 | 0.473 | 0.655 | −1.143 | 0.482 | 0.690 |
| −0.991 | 1.671 | 0.621 | −0.582 | 0.517 | 0.655 | −0.471 | 1.687 | 0.690 |
| −0.837 | 0.451 | 0.621 | −0.195 | 0.420 | 0.655 | −0.812 | 0.559 | 0.690 |
| −0.434 | 0.461 | 0.621 | −0.735 | 1.717 | 0.655 | −0.416 | 0.528 | 0.690 |
| −0.289 | 1.607 | 0.621 | −1.057 | 0.450 | 0.655 | −0.034 | 0.351 | 0.690 |
| −0.056 | 0.332 | 0.621 | −0.662 | 0.519 | 0.655 | 0.022 | 1.418 | 0.690 |
| −0.916 | 0.434 | 0.621 | −0.269 | 0.450 | 0.655 | −0.891 | 0.549 | 0.690 |
| −0.514 | 0.471 | 0.621 | −0.215 | 1.576 | 0.655 | −0.821 | 1.739 | 0.690 |
| −0.127 | 0.367 | 0.621 | 1.076 | 1.679 | 0.655 | −0.493 | 0.546 | 0.690 |
| −0.994 | 0.411 | 0.621 | −0.743 | 0.515 | 0.655 | −0.123 | 0.405 | 0.690 |
| −0.595 | 0.474 | 0.621 | −0.345 | 0.476 | 0.655 | −0.303 | 1.622 | 0.690 |
| −0.118 | 1.525 | 0.621 | 0.056 | 0.279 | 0.655 | −0.970 | 0.533 | 0.690 |
| −0.201 | 0.398 | 0.621 | −0.556 | 1.695 | 0.655 | −0.572 | 0.558 | 0.690 |
| −0.643 | 1.692 | 0.621 | −0.823 | 0.506 | 0.655 | −0.193 | 0.442 | 0.690 |
| −0.820 | 1.694 | 0.621 | −0.423 | 0.495 | 0.655 | −1.047 | 0.513 | 0.690 |
| −1.070 | 0.386 | 0.621 | −0.045 | 1.476 | 0.655 | −0.647 | 1.727 | 0.690 |
| −0.676 | 0.472 | 0.621 | −0.031 | 0.335 | 0.655 | −0.652 | 0.564 | 0.690 |
| −0.278 | 0.424 | 0.621 | −0.907 | 1.711 | 0.655 | −0.266 | 0.475 | 0.690 |
| −0.463 | 1.662 | 0.621 | −0.903 | 0.492 | 0.655 | −0.138 | 1.533 | 0.690 |
| −0.756 | 0.464 | 0.621 | −0.502 | 0.509 | 0.655 | −0.732 | 0.564 | 0.690 |
| 0.050 | 1.417 | 0.621 | 0.036 | 1.418 | 0.655 | −0.991 | 1.725 | 0.690 |
| −0.355 | 0.445 | 0.621 | −0.122 | 0.386 | 0.655 | −0.340 | 0.504 | 0.690 |
| 0.013 | 0.294 | 0.621 | −0.381 | 1.648 | 0.655 | 0.051 | 0.291 | 0.690 |
| 0.918 | 0.387 | 0.621 | 0.960 | 0.267 | 0.655 | 0.770 | 0.530 | 0.690 |
| 0.529 | 0.947 | 0.621 | 0.530 | 0.913 | 0.655 | 0.309 | 1.147 | 0.690 |
| 0.317 | 0.069 | 0.621 | 0.113 | 1.356 | 0.655 | 0.372 | 0.004 | 0.690 |
| 0.755 | −0.404 | 0.621 | 0.226 | 0.148 | 0.655 | 0.833 | −0.564 | 0.690 |
| 0.989 | 0.269 | 0.621 | 0.649 | −0.294 | 0.655 | 0.852 | 0.399 | 0.690 |
| 0.613 | 0.840 | 0.621 | 1.076 | 0.067 | 0.655 | 0.410 | 1.030 | 0.690 |

TABLE I-continued

| X | Y | Z' | X | Y | Z' | X | Y | Z' |
|---|---|---|---|---|---|---|---|---|
| 0.205 | 1.291 | 0.621 | 0.623 | 0.789 | 0.655 | 0.295 | 0.082 | 0.690 |
| 0.232 | 0.141 | 0.621 | 0.188 | 1.290 | 0.655 | 0.732 | −0.426 | 0.690 |
| 0.656 | −0.283 | 0.621 | 0.140 | 0.217 | 0.655 | 0.931 | 0.266 | 0.690 |
| 1.145 | −0.953 | 0.621 | 0.537 | −0.162 | 0.655 | 0.506 | 0.910 | 0.690 |
| 1.105 | 0.067 | 0.621 | 1.056 | −0.854 | 0.655 | 0.098 | 1.355 | 0.690 |
| 0.693 | 0.729 | 0.621 | 0.712 | 0.662 | 0.655 | 0.215 | 0.156 | 0.690 |
| 0.144 | 0.208 | 0.621 | 0.260 | 1.221 | 0.655 | 0.627 | −0.290 | 0.690 |
| 0.552 | −0.165 | 0.621 | 0.463 | −0.081 | 0.655 | 1.120 | −0.993 | 0.690 |
| 1.032 | −0.783 | 0.621 | 0.959 | −0.711 | 0.655 | 1.045 | 0.067 | 0.690 |
| 0.771 | 0.617 | 0.621 | 0.797 | 0.532 | 0.655 | 0.598 | 0.786 | 0.690 |
| 0.348 | 1.152 | 0.621 | 0.329 | 1.149 | 0.655 | 0.171 | 1.288 | 0.690 |
| 0.079 | 0.253 | 0.621 | 0.387 | −0.002 | 0.655 | 0.132 | 0.228 | 0.690 |
| 0.477 | −0.085 | 0.621 | 0.859 | −0.569 | 0.655 | 0.517 | −0.157 | 0.690 |
| 0.942 | −0.654 | 0.621 | 0.880 | 0.401 | 0.655 | 1.027 | −0.848 | 0.690 |
| 0.845 | 0.503 | 0.621 | 0.432 | 1.033 | 0.655 | 0.685 | 0.659 | 0.690 |
| 0.441 | 1.051 | 0.621 | 0.308 | 0.074 | 0.655 | 0.241 | 1.219 | 0.690 |
| 0.399 | −0.007 | 0.621 | 0.756 | −0.430 | 0.655 | 0.446 | −0.076 | 0.690 |
| 0.850 | −0.528 | 0.621 | 2.047 | −2.076 | 0.655 | 0.931 | −0.705 | 0.690 |
| 1.428 | −0.555 | 0.621 | 1.946 | −1.813 | 0.655 | 1.774 | −1.468 | 0.690 |
| 2.003 | −2.302 | 0.621 | 1.495 | −0.762 | 0.655 | 1.261 | −0.341 | 0.690 |
| 1.256 | −1.126 | 0.621 | 1.150 | −0.999 | 0.655 | 2.042 | −2.173 | 0.690 |
| 2.109 | −2.224 | 0.621 | 1.941 | −2.284 | 0.655 | 1.885 | −2.262 | 0.690 |
| 1.907 | −2.246 | 0.621 | 1.741 | −2.000 | 0.655 | 1.991 | −2.009 | 0.690 |
| 2.082 | −2.089 | 0.621 | 2.062 | −2.235 | 0.655 | 1.301 | −1.286 | 0.690 |
| 1.980 | −1.825 | 0.621 | 2.067 | −2.125 | 0.655 | 1.890 | −1.750 | 0.690 |
| 1.528 | −0.767 | 0.621 | 1.966 | −1.865 | 0.655 | 1.363 | −0.548 | 0.690 |
| 1.976 | −2.299 | 0.621 | 1.592 | −0.974 | 0.655 | 2.025 | −2.220 | 0.690 |
| 2.097 | −2.250 | 0.621 | 1.922 | −2.277 | 0.655 | 2.037 | −2.194 | 0.690 |
| 1.774 | −2.012 | 0.621 | 1.607 | −1.764 | 0.655 | 1.932 | −2.271 | 0.690 |
| 2.101 | −2.139 | 0.621 | 2.044 | −2.257 | 0.655 | 2.007 | −2.241 | 0.690 |
| 2.000 | −1.877 | 0.621 | 2.074 | −2.146 | 0.655 | 2.012 | −2.062 | 0.690 |
| 1.625 | −0.980 | 0.621 | 1.987 | −1.917 | 0.655 | 1.211 | −1.139 | 0.690 |
| 1.956 | −2.292 | 0.621 | 1.702 | −1.225 | 0.655 | 1.910 | −1.801 | 0.690 |
| 2.079 | −2.271 | 0.621 | 1.186 | −0.137 | 0.655 | 1.462 | −0.757 | 0.690 |
| 1.640 | −1.774 | 0.621 | 1.903 | −2.266 | 0.655 | 2.043 | −2.152 | 0.690 |
| 2.109 | −2.160 | 0.621 | 1.472 | −1.528 | 0.655 | 1.867 | −2.251 | 0.690 |
| 2.021 | −1.929 | 0.621 | 2.022 | −2.273 | 0.655 | 1.985 | −2.257 | 0.690 |
| 1.736 | −1.233 | 0.621 | 2.079 | −2.167 | 0.655 | 2.030 | −2.111 | 0.690 |
| 1.217 | −0.138 | 0.621 | 2.007 | −1.970 | 0.655 | 1.931 | −1.853 | 0.690 |
| 1.938 | −2.281 | 0.621 | 1.809 | −1.478 | 0.655 | 1.705 | −1.986 | 0.690 |
| 2.057 | −2.288 | 0.621 | 1.293 | −0.343 | 0.655 | 1.558 | −0.968 | 0.690 |
| 1.504 | −1.537 | 0.621 | 1.887 | −2.251 | 0.655 | 2.038 | −2.131 | 0.690 |
| 2.113 | −2.181 | 0.621 | 1.333 | −1.294 | 0.655 | 1.905 | −2.268 | 0.690 |
| 2.041 | −1.982 | 0.621 | 1.996 | −2.284 | 0.655 | 1.851 | −2.236 | 0.690 |
| 1.843 | −1.487 | 0.621 | 2.079 | −2.188 | 0.655 | 1.951 | −1.905 | 0.690 |
| 1.324 | −0.345 | 0.621 | 2.027 | −2.023 | 0.655 | 1.573 | −1.753 | 0.690 |
| 1.921 | −2.266 | 0.621 | 1.925 | −1.762 | 0.655 | 1.668 | −1.217 | 0.690 |
| 2.031 | −2.298 | 0.621 | 1.396 | −0.552 | 0.655 | 1.155 | −0.136 | 0.690 |
| 1.364 | −1.301 | 0.621 | 1.873 | −2.232 | 0.655 | 1.960 | −2.267 | 0.690 |
| 2.113 | −2.202 | 0.621 | 1.243 | −1.146 | 0.655 | 1.837 | −2.217 | 0.690 |
| 2.061 | −2.035 | 0.621 | 1.969 | −2.287 | 0.655 | 1.971 | −1.956 | 0.690 |
| 1.959 | −1.773 | 0.621 | 2.074 | −2.209 | 0.655 | 1.438 | −1.519 | 0.690 |
| −2.145 | 0.783 | 0.724 | −1.388 | 1.659 | 0.759 | −1.943 | 1.243 | 0.793 |
| −2.209 | 0.540 | 0.724 | −1.746 | 1.402 | 0.759 | −2.157 | 0.904 | 0.793 |
| −2.173 | 0.354 | 0.724 | −2.024 | 1.070 | 0.759 | −2.217 | 0.668 | 0.793 |
| −2.025 | 0.254 | 0.724 | −2.185 | 0.749 | 0.759 | −2.166 | 0.493 | 0.793 |
| −1.795 | 0.275 | 0.724 | −2.208 | 0.518 | 0.759 | −2.010 | 0.409 | 0.793 |
| −1.866 | 1.224 | 0.724 | −2.121 | 0.372 | 0.759 | −1.781 | 0.438 | 0.793 |
| −2.108 | 0.862 | 0.724 | −1.931 | 0.326 | 0.759 | −1.877 | 1.319 | 0.793 |
| −2.203 | 0.590 | 0.724 | −1.676 | 0.395 | 0.759 | −2.136 | 0.949 | 0.793 |
| −2.189 | 0.386 | 0.724 | −0.080 | 1.481 | 0.759 | −2.213 | 0.717 | 0.793 |
| −2.066 | 0.266 | 0.724 | −1.221 | 0.583 | 0.759 | −2.185 | 0.521 | 0.793 |
| −1.851 | 0.260 | 0.724 | −0.756 | 0.658 | 0.759 | −2.051 | 0.418 | 0.793 |
| −1.808 | 1.289 | 0.724 | −0.901 | 1.783 | 0.759 | −1.837 | 0.423 | 0.793 |
| −2.066 | 0.939 | 0.724 | −0.340 | 0.557 | 0.759 | −1.808 | 1.392 | 0.793 |
| −2.193 | 0.639 | 0.724 | 0.027 | 0.319 | 0.759 | −2.113 | 0.993 | 0.793 |
| −2.201 | 0.419 | 0.724 | −1.680 | 1.462 | 0.759 | −2.204 | 0.765 | 0.793 |
| −2.098 | 0.282 | 0.724 | −1.975 | 1.142 | 0.759 | −2.200 | 0.552 | 0.793 |
| −1.895 | 0.252 | 0.724 | −2.169 | 0.797 | 0.759 | −2.085 | 0.430 | 0.793 |
| −1.747 | 1.354 | 0.724 | −2.212 | 0.554 | 0.759 | −1.881 | 0.414 | 0.793 |
| −2.021 | 1.013 | 0.724 | −2.147 | 0.395 | 0.759 | −1.744 | 1.453 | 0.793 |
| −2.180 | 0.688 | 0.724 | −1.975 | 0.326 | 0.759 | −2.061 | 1.080 | 0.793 |
| −2.207 | 0.454 | 0.724 | −1.732 | 0.374 | 0.759 | −2.192 | 0.812 | 0.793 |
| −2.127 | 0.302 | 0.724 | −0.005 | 1.420 | 0.759 | −2.209 | 0.586 | 0.793 |
| −1.939 | 0.248 | 0.724 | −1.314 | 0.549 | 0.759 | −2.115 | 0.447 | 0.793 |
| −1.683 | 0.315 | 0.724 | −0.395 | 1.676 | 0.759 | −1.924 | 0.408 | 0.793 |
| −1.682 | 1.415 | 0.724 | −0.848 | 0.658 | 0.759 | −1.671 | 0.477 | 0.793 |

TABLE I-continued

| X | Y | Z' | X | Y | Z' | X | Y | Z' |
|---|---|---|---|---|---|---|---|---|
| −1.972 | 1.086 | 0.724 | −0.412 | 0.587 | 0.759 | −1.678 | 1.510 | 0.793 |
| −2.164 | 0.736 | 0.724 | −1.232 | 1.724 | 0.759 | −2.004 | 1.163 | 0.793 |
| −2.210 | 0.490 | 0.724 | −0.052 | 0.382 | 0.759 | −2.176 | 0.858 | 0.793 |
| −2.152 | 0.326 | 0.724 | −1.612 | 1.518 | 0.759 | −2.215 | 0.621 | 0.793 |
| −1.983 | 0.248 | 0.724 | −1.922 | 1.210 | 0.759 | −2.143 | 0.468 | 0.793 |
| −1.739 | 0.294 | 0.724 | −2.150 | 0.843 | 0.759 | −1.968 | 0.406 | 0.793 |
| −1.920 | 1.156 | 0.724 | −2.213 | 0.603 | 0.759 | −1.726 | 0.456 | 0.793 |
| −1.413 | 0.437 | 0.724 | −2.169 | 0.422 | 0.759 | −1.227 | 1.758 | 0.793 |
| −1.543 | 1.527 | 0.724 | −2.017 | 0.330 | 0.759 | −1.609 | 1.563 | 0.793 |
| −1.503 | 0.395 | 0.724 | −1.787 | 0.355 | 0.759 | −1.399 | 0.587 | 0.793 |
| −1.593 | 0.354 | 0.724 | 0.067 | 1.354 | 0.759 | −1.536 | 1.613 | 0.793 |
| −1.134 | 0.547 | 0.724 | 1.406 | 0.512 | 0.759 | −1.490 | 0.550 | 0.793 |
| −1.391 | 1.621 | 0.724 | −0.939 | 0.650 | 0.759 | −1.580 | 0.513 | 0.793 |
| −1.228 | 0.514 | 0.724 | −0.733 | 1.775 | 0.759 | −1.118 | 0.677 | 0.793 |
| −1.321 | 0.477 | 0.724 | −0.486 | 0.612 | 0.759 | −1.383 | 1.697 | 0.793 |
| −1.236 | 1.690 | 0.724 | −0.136 | 0.442 | 0.759 | −1.214 | 0.652 | 0.793 |
| −0.960 | 0.592 | 0.724 | −1.540 | 1.569 | 0.759 | −1.307 | 0.621 | 0.793 |
| −0.735 | 1.756 | 0.724 | −1.867 | 1.276 | 0.759 | −0.406 | 0.611 | 0.793 |
| −0.566 | 0.596 | 0.724 | −2.113 | 0.921 | 0.759 | −0.042 | 0.379 | 0.793 |
| −0.196 | 0.463 | 0.724 | −2.208 | 0.652 | 0.759 | −0.322 | 1.643 | 0.793 |
| −0.231 | 1.587 | 0.724 | −2.187 | 0.452 | 0.759 | −0.932 | 0.705 | 0.793 |
| −1.037 | 0.575 | 0.724 | −2.058 | 0.340 | 0.759 | −0.731 | 1.793 | 0.793 |
| −0.645 | 0.606 | 0.724 | −1.844 | 0.340 | 0.759 | −0.486 | 0.643 | 0.793 |
| −1.073 | 1.737 | 0.724 | −1.496 | 0.472 | 0.759 | −0.110 | 0.433 | 0.793 |
| −0.266 | 0.499 | 0.724 | −0.239 | 1.592 | 0.759 | −0.247 | 1.597 | 0.793 |
| −0.148 | 1.536 | 0.724 | −1.029 | 0.636 | 0.759 | −1.021 | 0.695 | 0.793 |
| −0.560 | 1.724 | 0.724 | −0.575 | 0.635 | 0.759 | −0.572 | 0.670 | 0.793 |
| −0.724 | 0.611 | 0.724 | −1.069 | 1.766 | 0.759 | −1.064 | 1.795 | 0.793 |
| −0.338 | 0.531 | 0.724 | −0.202 | 0.483 | 0.759 | −0.180 | 0.483 | 0.793 |
| 0.041 | 0.305 | 0.724 | −1.808 | 1.340 | 0.759 | −0.155 | 1.533 | 0.793 |
| −0.068 | 1.480 | 0.724 | −2.070 | 0.997 | 0.759 | −0.562 | 1.751 | 0.793 |
| −0.803 | 0.610 | 0.724 | −2.198 | 0.701 | 0.759 | −0.661 | 0.690 | 0.793 |
| −0.904 | 1.759 | 0.724 | −2.200 | 0.484 | 0.759 | −0.253 | 0.530 | 0.793 |
| −0.413 | 0.558 | 0.724 | −2.091 | 0.354 | 0.759 | −0.067 | 1.462 | 0.793 |
| −0.042 | 0.366 | 0.724 | −1.887 | 0.332 | 0.759 | −0.751 | 0.702 | 0.793 |
| 0.008 | 1.419 | 0.724 | −1.586 | 0.433 | 0.759 | −0.897 | 1.807 | 0.793 |
| −0.391 | 1.667 | 0.724 | −0.158 | 1.539 | 0.759 | −0.328 | 0.573 | 0.793 |
| −0.882 | 0.603 | 0.724 | −1.126 | 0.612 | 0.759 | 0.023 | 0.324 | 0.793 |
| −0.488 | 0.580 | 0.724 | −0.561 | 1.738 | 0.759 | 0.017 | 1.388 | 0.793 |
| −0.128 | 0.423 | 0.724 | −0.665 | 0.650 | 0.759 | −0.399 | 1.684 | 0.793 |
| 0.846 | −0.618 | 0.724 | −0.270 | 0.522 | 0.759 | −0.841 | 0.708 | 0.793 |
| 0.901 | 0.265 | 0.724 | 0.104 | 0.253 | 0.759 | 0.360 | −0.029 | 0.793 |
| 0.482 | 0.907 | 0.724 | 0.590 | −0.294 | 0.759 | 0.890 | −0.761 | 0.793 |
| 0.082 | 1.355 | 0.724 | 1.791 | −2.217 | 0.759 | 0.764 | 0.396 | 0.793 |
| 0.220 | 0.148 | 0.724 | 1.130 | −1.099 | 0.759 | 0.097 | 1.309 | 0.793 |
| 0.734 | −0.458 | 0.724 | 1.908 | −2.223 | 0.759 | 0.342 | 1.024 | 0.793 |
| 1.036 | 0.027 | 0.724 | 1.761 | −2.184 | 0.759 | 0.273 | 0.072 | 0.793 |
| 0.572 | 0.783 | 0.724 | 1.966 | −2.119 | 0.759 | 0.784 | −0.600 | 0.793 |
| 0.154 | 1.287 | 0.724 | 1.896 | −1.928 | 0.759 | ,0.973 | 0.029 | 0.793 |
| 0.119 | 0.240 | 0.724 | 0.714 | 0.527 | 0.759 | 0.604 | 0.654 | 0.793 |
| 0.617 | −0.302 | 0.724 | 1.815 | −1.724 | 0.759 | 0.174 | 1.227 | 0.793 |
| 0.659 | 0.657 | 0.724 | 0.268 | 1.143 | 0.759 | 0.182 | 0.171 | 0.793 |
| 0.222 | 1.217 | 0.724 | 1.255 | −0.457 | 0.759 | 0.675 | −0.442 | 0.793 |
| 0.495 | −0.150 | 0.724 | 0.470 | −0.141 | 0.759 | 0.841 | 0.265 | 0.793 |
| 1.061 | −0.943 | 0.724 | 1.775 | −2.203 | 0.759 | 1.099 | −0.210 | 0.793 |
| 0.742 | 0.528 | 0.724 | 1.028 | −0.934 | 0.759 | 0.433 | 0.904 | 0.793 |
| 0.288 | 1.145 | 0.724 | 1.882 | −2.233 | 0.759 | 0.087 | 0.266 | 0.793 |
| 0.407 | −0.048 | 0.724 | 1.630 | −1.957 | 0.759 | 0.562 | −0.285 | 0.793 |
| 0.955 | −0.780 | 0.724 | 1.965 | −2.140 | 0.759 | 1.095 | −1.088 | 0.793 |
| 0.823 | 0.397 | 0.724 | 1.916 | −1.979 | 0.759 | 0.685 | 0.526 | 0.793 |
| 0.388 | 1.028 | 0.724 | 0.794 | 0.397 | 0.759 | 0.247 | 1.142 | 0.793 |
| 0.316 | 0.052 | 0.724 | 0.365 | 1.026 | 0.759 | 0.444 | −0.132 | 0.793 |
| 1.830 | −2.234 | 0.724 | 1.595 | −1.199 | 0.759 | 0.993 | −0.924 | 0.793 |
| 1.403 | −1.507 | 0.724 | 1.005 | 0.028 | 0.759 | 0.520 | 0.780 | 0.793 |
| 1.947 | −2.241 | 0.724 | 0.385 | −0.039 | 0.759 | 1.788 | −2.216 | 0.793 |
| 1.523 | −0.961 | 0.724 | 0.923 | −0.771 | 0.759 | 1.461 | −1.712 | 0.793 |
| 1.999 | −2.178 | 0.724 | 1.855 | −2.237 | 0.759 | 1.906 | −2.169 | 0.793 |
| 1.974 | −2.047 | 0.724 | 1.499 | −1.727 | 0.759 | 1.915 | −2.064 | 0.793 |
| 1.873 | −1.788 | 0.724 | 1.959 | −2.161 | 0.759 | 1.817 | −1.811 | 0.793 |
| 1.814 | −2.220 | 0.724 | 1.936 | −2.032 | 0.759 | 1.451 | −0.945 | 0.793 |
| 1.266 | −1.276 | 0.724 | 1.835 | −1.775 | 0.759 | 1.769 | −2.210 | 0.793 |
| 1.922 | −2.251 | 0.724 | 0.458 | 0.905 | 0.759 | 1.329 | −1.482 | 0.793 |
| 1.632 | −1.208 | 0.724 | 1.373 | −0.704 | 0.759 | 1.889 | −2.190 | 0.793 |
| 2.005 | −2.136 | 0.724 | 0.295 | 0.062 | 0.759 | 1.922 | −2.083 | 0.793 |
| 1.934 | −1.942 | 0.724 | 0.816 | −0.610 | 0.759 | 1.837 | −1.861 | 0.793 |
| 1.800 | −2.200 | 0.724 | 1.828 | −2.234 | 0.759 | 1.558 | −1.189 | 0.793 |
| 1.165 | −1.109 | 0.724 | 1.366 | −1.495 | 0.759 | 1.751 | −2.200 | 0.793 |

TABLE I-continued

| X | Y | Z' | X | Y | Z' | X | Y | Z' |
|---|---|---|---|---|---|---|---|---|
| 1.894 | −2.254 | 0.724 | 1.947 | −2.187 | 0.759 | 1.195 | −1.253 | 0.793 |
| 1.738 | −1.457 | 0.724 | 1.954 | −2.080 | 0.759 | 1.867 | −2.205 | 0.793 |
| 1.165 | −0.216 | 0.724 | 1.856 | −1.826 | 0.759 | 1.926 | −2.102 | 0.793 |
| 1.993 | −2.096 | 0.724 | 0.546 | 0.781 | 0.759 | 1.857 | −1.912 | 0.793 |
| 1.894 | −1.840 | 0.724 | 1.701 | −1.446 | 0.759 | 1.663 | −1.434 | 0.793 |
| 1.867 | −2.252 | 0.724 | 0.136 | 1.286 | 0.759 | 1.736 | −2.185 | 0.793 |
| 1.668 | −1.972 | 0.724 | 1.132 | −0.213 | 0.759 | 1.842 | −2.215 | 0.793 |
| 1.986 | −2.204 | 0.724 | 0.202 | 0.159 | 0.759 | 1.925 | −2.123 | 0.793 |
| 1.289 | −0.462 | 0.724 | 0.705 | −0.451 | 0.759 | 1.876 | −1.963 | 0.793 |
| 2.004 | −2.157 | 0.724 | 1.809 | −2.228 | 0.759 | 1.776 | −1.710 | 0.793 |
| 1.954 | −1.995 | 0.724 | 1.231 | −1.265 | 0.759 | 1.221 | −0.453 | 0.793 |
| 1.853 | −1.737 | 0.724 | 1.929 | −2.207 | 0.759 | 1.722 | −2.166 | 0.793 |
| 1.848 | −2.245 | 0.724 | 1.962 | −2.100 | 0.759 | 1.815 | −2.219 | 0.793 |
| 1.537 | −1.740 | 0.724 | 1.876 | −1.876 | 0.759 | 1.591 | −1.941 | 0.793 |
| 1.969 | −2.225 | 0.724 | 0.632 | 0.655 | 0.759 | 1.919 | −2.144 | 0.793 |
| 1.408 | −0.710 | 0.724 | 0.203 | 1.216 | 0.759 | 1.896 | −2.016 | 0.793 |
| 2.000 | −2.116 | 0.724 | 1.487 | −0.953 | 0.759 | 1.797 | −1.760 | 0.793 |
| 1.914 | −1.891 | 0.724 | 0.871 | 0.265 | 0.759 | 1.337 | −0.698 | 0.793 |
| −1.807 | 1.446 | 0.828 | −1.932 | 1.377 | 0.862 | −2.066 | 0.676 | 0.897 |
| −2.118 | 1.057 | 0.828 | −2.158 | 1.061 | 0.862 | −1.843 | 0.680 | 0.897 |
| −2.210 | 0.832 | 0.828 | −2.225 | 0.808 | 0.862 | −2.050 | 1.307 | 0.897 |
| −2.200 | 0.624 | 0.828 | −2.160 | 0.644 | 0.862 | −2.212 | 1.018 | 0.897 |
| −2.079 | 0.509 | 0.828 | −1.997 | 0.576 | 0.862 | −2.213 | 0.803 | 0.897 |
| −1.875 | 0.499 | 0.828 | −1.743 | 0.618 | 0.862 | −2.099 | 0.688 | 0.897 |
| −1.742 | 1.504 | 0.828 | −1.871 | 1.441 | 0.862 | −1.891 | 0.672 | 0.897 |
| −2.065 | 1.142 | 0.828 | −2.129 | 1.116 | 0.862 | −1.994 | 1.374 | 0.897 |
| −2.198 | 0.879 | 0.828 | −2.224 | 0.855 | 0.862 | −2.191 | 1.075 | 0.897 |
| −2.211 | 0.656 | 0.828 | −2.182 | 0.669 | 0.862 | −2.223 | 0.835 | 0.897 |
| −2.110 | 0.524 | 0.828 | −2.039 | 0.582 | 0.862 | −2.129 | 0.704 | 0.897 |
| −1.918 | 0.493 | 0.828 | −1.827 | 0.595 | 0.862 | −1.938 | 0.666 | 0.897 |
| −1.675 | 1.559 | 0.828 | −1.806 | 1.501 | 0.862 | −1.702 | 0.716 | 0.897 |
| −2.007 | 1.224 | 0.828 | −2.096 | 1.168 | 0.862 | −1.934 | 1.438 | 0.897 |
| −2.182 | 0.925 | 0.828 | −2.217 | 0.901 | 0.862 | −2.165 | 1.130 | 0.897 |
| −2.218 | 0.690 | 0.828 | −2.199 | 0.697 | 0.862 | −2.230 | 0.880 | 0.897 |
| −2.139 | 0.544 | 0.828 | −2.073 | 0.591 | 0.862 | −2.156 | 0.723 | 0.897 |
| −1.961 | 0.490 | 0.828 | −1.869 | 0.587 | 0.862 | −1.986 | 0.664 | 0.897 |
| −1.721 | 0.541 | 0.828 | −1.740 | 1.556 | 0.862 | −1.749 | 0.703 | 0.897 |
| −1.944 | 1.302 | 0.828 | −2.045 | 1.241 | 0.862 | −1.669 | 1.659 | 0.897 |
| −2.163 | 0.970 | 0.828 | −2.205 | 0.948 | 0.862 | −1.871 | 1.499 | 0.897 |
| −2.221 | 0.737 | 0.828 | −2.212 | 0.728 | 0.862 | −2.135 | 1.184 | 0.897 |
| −2.163 | 0.567 | 0.828 | −2.105 | 0.605 | 0.862 | −2.230 | 0.927 | 0.897 |
| −2.004 | 0.491 | 0.828 | −1.912 | 0.580 | 0.862 | −2.179 | 0.746 | 0.897 |
| −1.776 | 0.523 | 0.828 | −1.672 | 1.609 | 0.862 | −2.032 | 0.668 | 0.897 |
| −1.878 | 1.376 | 0.828 | −1.990 | 1.311 | 0.862 | −1.796 | 0.691 | 0.897 |
| −2.142 | 1.014 | 0.828 | −2.184 | 1.005 | 0.862 | −1.575 | 0.755 | 0.897 |
| 2.218 | 0.785 | 0.828 | −2.220 | 0.762 | 0.862 | −1.168 | 0.853 | 0.897 |
| −2.184 | 0.594 | 0.828 | −2.134 | 0.622 | 0.862 | −1.446 | 1.783 | 0.897 |
| −2.045 | 0.498 | 0.828 | −1.955 | 0.576 | 0.862 | −1.655 | 0.730 | 0.897 |
| −1.832 | 0.508 | 0.828 | −1.660 | 0.645 | 0.862 | −1.251 | 0.840 | 0.897 |
| −1.099 | 0.741 | 0.828 | −1.259 | 0.773 | 0.862 | −1.366 | 1.814 | 0.897 |
| −1.456 | 1.699 | 0.828 | −1.601 | 1.657 | 0.862 | −1.597 | 1.705 | 0.897 |
| −1.586 | 0.590 | 0.828 | −1.341 | 0.751 | 0.862 | −1.333 | 0.823 | 0.897 |
| −1.183 | 0.725 | 0.828 | −1.527 | 1.701 | 0.862 | −1.415 | 0.803 | 0.897 |
| −1.665 | 0.560 | 0.828 | −1.422 | 0.727 | 0.862 | −1.209 | 1.858 | 0.897 |
| −1.266 | 0.703 | 0.828 | −1.451 | 1.741 | 0.862 | −1.495 | 0.779 | 0.897 |
| −1.300 | 1.767 | 0.828 | −1.502 | 0.700 | 0.862 | −1.739 | 1.610 | 0.897 |
| −1.347 | 0.678 | 0.828 | −1.092 | 0.802 | 0.862 | −1.806 | 1.557 | 0.897 |
| −1.605 | 1.610 | 0.828 | −1.215 | 1.825 | 0.862 | −1.523 | 1.746 | 0.897 |
| −1.428 | 0.650 | 0.828 | −1.372 | 1.775 | 0.862 | −2.102 | 1.235 | 0.897 |
| −1.140 | 1.811 | 0.828 | −1.581 | 0.672 | 0.862 | −2.224 | 0.973 | 0.897 |
| −1.507 | 0.620 | 0.828 | −1.176 | 0.790 | 0.862 | −2.198 | 0.773 | 0.897 |
| −0.254 | 1.602 | 0.828 | −0.889 | 1.852 | 0.862 | −0.271 | 1.610 | 0.897 |
| −0.645 | 1.790 | 0.828 | −0.830 | 0.800 | 0.862 | −0.739 | 0.820 | 0.897 |
| −0.658 | 0.727 | 0.828 | −0.175 | 1.538 | 0.862 | −0.331 | 0.618 | 0.897 |
| −0.261 | 0.550 | 0.828 | −0.404 | 0.652 | 0.862 | −1.047 | 1.879 | 0.897 |
| 0.067 | 0.278 | 0.828 | −0.563 | 1.776 | 0.862 | 0.026 | 0.301 | 0.897 |
| −0.404 | 1.692 | 0.828 | −0.022 | 0.359 | 0.862 | −0.186 | 1.540 | 0.897 |
| 0.002 | 1.388 | 0.828 | −0.918 | 0.808 | 0.862 | −0.824 | 0.841 | 0.897 |
| −0.746 | 0.745 | 0.828 | −1.053 | 1.852 | 0.862 | −0.565 | 1.787 | 0.897 |
| −0.976 | 1.830 | 0.828 | −0.092 | 1.465 | 0.862 | −0.411 | 0.672 | 0.897 |
| −0.334 | 0.595 | 0.828 | −0.490 | 0.697 | 0.862 | −0.041 | 0.369 | 0.897 |
| 0.006 | 0.337 | 0.828 | −0.485 | 1.740 | 0.862 | −0.105 | 1.466 | 0.897 |
| −0.165 | 1.535 | 0.828 | −0.093 | 0.424 | 0.862 | −0.911 | 0.855 | 0.897 |
| −0.835 | 0.755 | 0.828 | −0.644 | 1.805 | 0.862 | −0.488 | 1.749 | 0.897 |
| −0.409 | 0.636 | 0.828 | −1.007 | 0.808 | 0.862 | −0.494 | 0.720 | 0.897 |
| −0.058 | 0.394 | 0.828 | −0.012 | 1.388 | 0.862 | −0.885 | 1.874 | 0.897 |
| −0.328 | 1.649 | 0.828 | −0.572 | 0.733 | 0.862 | −0.110 | 0.436 | 0.897 |

TABLE I-continued

| X | Y | Z' | X | Y | Z' | X | Y | Z' |
|---|---|---|---|---|---|---|---|---|
| −0.925 | 0.758 | 0.828 | −0.408 | 1.700 | 0.862 | −0.028 | 1.389 | 0.897 |
| −0.811 | 1.824 | 0.828 | −0.166 | 0.487 | 0.862 | −0.999 | 0.860 | 0.897 |
| −0.487 | 0.671 | 0.828 | 0.063 | 1.308 | 0.862 | −0.413 | 1.707 | 0.897 |
| −0.123 | 0.449 | 0.828 | −0.656 | 0.762 | 0.862 | −0.573 | 0.759 | 0.897 |
| −0.079 | 1.464 | 0.828 | −0.334 | 1.655 | 0.862 | −0.181 | 0.500 | 0.897 |
| −1.014 | 0.753 | 0.828 | −0.242 | 0.546 | 0.862 | 0.046 | 1.309 | 0.897 |
| −0.482 | 1.731 | 0.828 | −0.727 | 1.828 | 0.862 | −1.084 | 0.859 | 0.897 |
| −0.571 | 0.703 | 0.828 | −0.742 | 0.785 | 0.862 | −0.341 | 1.660 | 0.897 |
| −0.191 | 0.501 | 0.828 | −0.262 | 1.606 | 0.862 | −0.655 | 0.793 | 0.897 |
| 0.335 | 1.004 | 0.828 | −0.322 | 0.602 | 0.862 | −0.725 | 1.844 | 0.897 |
| 0.533 | −0.276 | 0.828 | 0.047 | 0.291 | 0.862 | −0.255 | 0.561 | 0.897 |
| 1.059 | −1.076 | 0.828 | 0.692 | 0.419 | 0.862 | 1.116 | −0.435 | 0.897 |
| 0.941 | 0.031 | 0.828 | 0.206 | 1.141 | 0.862 | 0.574 | 0.569 | 0.897 |
| 0.438 | 0.862 | 0.828 | 0.389 | −0.112 | 0.862 | 0.117 | 1.226 | 0.897 |
| 0.417 | −0.122 | 0.828 | 1.006 | −1.037 | 0.862 | 0.490 | −0.282 | 0.897 |
| 0.958 | −0.913 | 0.828 | 0.780 | 0.267 | 0.862 | 1.083 | −1.214 | 0.897 |
| 1.066 | −0.207 | 0.828 | 0.312 | 1.003 | 0.862 | 0.663 | 0.420 | 0.897 |
| 0.536 | 0.716 | 0.828 | 0.308 | −0.008 | 0.862 | 0.185 | 1.141 | 0.897 |
| 0.080 | 1.308 | 0.828 | 0.889 | −0.848 | 0.862 | 0.361 | −0.103 | 0.897 |
| 0.335 | −0.018 | 0.828 | 0.909 | 0.034 | 0.862 | 0.969 | −1.024 | 0.897 |
| 0.856 | −0.751 | 0.828 | 0.413 | 0.861 | 0.862 | 0.749 | 0.270 | 0.897 |
| 0.630 | 0.568 | 0.828 | 0.224 | 0.094 | 0.862 | 0.289 | 1.003 | 0.897 |
| 0.155 | 1.226 | 0.828 | 0.770 | −0.660 | 0.862 | 0.281 | 0.001 | 0.897 |
| 0.249 | 0.083 | 0.828 | 1.032 | −0.203 | 0.862 | 0.854 | −0.836 | 0.897 |
| 0.751 | −0.591 | 0.828 | 0.509 | 0.716 | 0.862 | 0.876 | 0.037 | 0.897 |
| 0.722 | 0.418 | 0.828 | 0.137 | 0.194 | 0.862 | 0.388 | 0.862 | 0.897 |
| 0.227 | 1.141 | 0.828 | 0.648 | −0.475 | 0.862 | 0.199 | 0.104 | 0.897 |
| 0.160 | 0.182 | 0.828 | 0.602 | 0.568 | 0.862 | 0.736 | −0.650 | 0.897 |
| 0.644 | −0.432 | 0.828 | 0.136 | 1.226 | 0.862 | 0.998 | −0.198 | 0.897 |
| 0.810 | 0.266 | 0.828 | 0.521 | −0.292 | 0.862 | 0.483 | 0.717 | 0.897 |
| 1.729 | −2.191 | 0.828 | 1.120 | −1.228 | 0.862 | 0.114 | 0.204 | 0.897 |
| 1.848 | −2.171 | 0.828 | 1.265 | −0.683 | 0.862 | 0.615 | −0.465 | 0.897 |
| 1.682 | −2.148 | 0.828 | 1.707 | −2.178 | 0.862 | 1.657 | −1.663 | 0.897 |
| 1.882 | −2.065 | 0.828 | 1.823 | −2.132 | 0.862 | 1.600 | −2.109 | 0.897 |
| 1.797 | −1.846 | 0.828 | 1.833 | −2.028 | 0.862 | 1.692 | −2.159 | 0.897 |
| 1.521 | −1.178 | 0.828 | 1.737 | −1.779 | 0.862 | 1.794 | −2.087 | 0.897 |
| 1.711 | −2.181 | 0.828 | 1.377 | −0.926 | 0.862 | 1.774 | −1.962 | 0.897 |
| 1.826 | −2.186 | 0.828 | 1.688 | −2.172 | 0.862 | 1.677 | −1.713 | 0.897 |
| 1.552 | −1.925 | 0.828 | 1.512 | −1.907 | 0.862 | 1.229 | −0.675 | 0.897 |
| 1.886 | −2.084 | 0.828 | 1.806 | −2.152 | 0.862 | 1.665 | −2.157 | 0.897 |
| 1.817 | −1.896 | 0.828 | 1.841 | −2.047 | 0.862 | 1.781 | −2.111 | 0.897 |
| 1.624 | −1.421 | 0.828 | 1.757 | −1.829 | 0.862 | 1.792 | −2.009 | 0.897 |
| 1.695 | −2.167 | 0.828 | 1.483 | −1.166 | 0.862 | 1.697 | −1.762 | 0.897 |
| 1.801 | −2.196 | 0.828 | 1.670 | −2.162 | 0.862 | 1.339 | −0.916 | 0.897 |
| 1.422 | −1.697 | 0.828 | 1.383 | −1.681 | 0.862 | 1.647 | −2.151 | 0.897 |
| 1.884 | −2.105 | 0.828 | 1.785 | −2.166 | 0.862 | 1.764 | −2.131 | 0.897 |
| 1.836 | −1.947 | 0.828 | 1.845 | −2.066 | 0.862 | 1.471 | −1.889 | 0.897 |
| 1.737 | −1.695 | 0.828 | 1.776 | −1.879 | 0.862 | 1.800 | −2.027 | 0.897 |
| 1.186 | −0.448 | 0.828 | 1.586 | −1.408 | 0.862 | 1.716 | −1.811 | 0.897 |
| 1.775 | −2.200 | 0.828 | 1.655 | −2.148 | 0.862 | 1.444 | −1.154 | 0.897 |
| 1.291 | −1.469 | 0.828 | 1.252 | −1.454 | 0.862 | 1.629 | −2.141 | 0.897 |
| 1.878 | −2.126 | 0.828 | 1.760 | −2.176 | 0.862 | 1.743 | −2.146 | 0.897 |
| 1.856 | −1.999 | 0.828 | 1.843 | −2.086 | 0.862 | 1.343 | −1.665 | 0.897 |
| 1.757 | −1.745 | 0.828 | 1.796 | −1.929 | 0.862 | 1.803 | −2.046 | 0.897 |
| 1.302 | −0.691 | 0.828 | 1.697 | −1.680 | 0.862 | 1.736 | −1.860 | 0.897 |
| 1.748 | −2.197 | 0.828 | 1.151 | −0.442 | 0.862 | 1.546 | −1.393 | 0.897 |
| 1.157 | −1.241 | 0.828 | 1.641 | −2.129 | 0.862 | 1.613 | −2.127 | 0.897 |
| 1.865 | −2.151 | 0.828 | 1.734 | −2.180 | 0.862 | 1.719 | −2.155 | 0.897 |
| 1.874 | −2.046 | 0.828 | 1.836 | −2.107 | 0.862 | 1.214 | −1.439 | 0.897 |
| 1.777 | −1.795 | 0.828 | 1.815 | −1.981 | 0.862 | 1.801 | −2.066 | 0.897 |
| 1.414 | −0.936 | 0.828 | 1.717 | −1.730 | 0.862 | 1.755 | −1.911 | 0.897 |
| −2.234 | 1.018 | 0.931 | −2.005 | 1.508 | 0.966 | −1.878 | 1.694 | 1.000 |
| −2.195 | 0.852 | 0.931 | −2.193 | 1.256 | 0.966 | −2.153 | 1.421 | 1.000 |
| −2.057 | 0.764 | 0.931 | −2.238 | 1.061 | 0.966 | −2.240 | 1.216 | 1.000 |
| −1.835 | 0.772 | 0.931 | −2.167 | 0.912 | 0.966 | −2.199 | 1.046 | 1.000 |
| −1.806 | 1.614 | 0.931 | −2.012 | 0.855 | 0.966 | −2.051 | 0.963 | 1.000 |
| −2.109 | 1.304 | 0.931 | −1.744 | 0.883 | 0.966 | −1.765 | 0.973 | 1.000 |
| −2.229 | 1.054 | 0.931 | −1.943 | 1.568 | 0.966 | −1.800 | 1.748 | 1.000 |
| −2.212 | 0.880 | 0.931 | −2.170 | 1.298 | 0.966 | −2.121 | 1.463 | 1.000 |
| −2.090 | 0.774 | 0.931 | −2.239 | 1.097 | 0.966 | −2.233 | 1.255 | 1.000 |
| −1.882 | 0.764 | 0.931 | −2.190 | 0.936 | 0.966 | −2.217 | 1.076 | 1.000 |
| −1.738 | 1.664 | 0.931 | −2.046 | 0.859 | 0.966 | −2.086 | 0.971 | 1.000 |
| −2.056 | 1.373 | 0.931 | −1.798 | 0.873 | 0.966 | −1.828 | 0.965 | 1.000 |
| −2.220 | 1.090 | 0.931 | −1.877 | 1.624 | 0.966 | −1.728 | 1.790 | 1.000 |
| −2.224 | 0.911 | 0.931 | −2.145 | 1.339 | 0.966 | −2.088 | 1.504 | 1.000 |
| −2.121 | 0.788 | 0.931 | −2.235 | 1.132 | 0.966 | −2.221 | 1.293 | 1.000 |
| −1.930 | 0.758 | 0.931 | −2.208 | 0.963 | 0.966 | −2.231 | 1.108 | 1.000 |

TABLE I-continued

| X | Y | Z' | X | Y | Z' | X | Y | Z' |
|---|---|---|---|---|---|---|---|---|
| −1.694 | 0.805 | 0.931 | −2.080 | 0.867 | 0.966 | −2.119 | 0.983 | 1.000 |
| −1.668 | 1.711 | 0.931 | −1.852 | 0.864 | 0.966 | −1.891 | 0.958 | 1.000 |
| −1.999 | 1.439 | 0.931 | −1.808 | 1.675 | 0.966 | −2.023 | 1.572 | 1.000 |
| −2.199 | 1.146 | 0.931 | −2.117 | 1.378 | 0.966 | −2.205 | 1.330 | 1.000 |
| −2.232 | 0.946 | 0.931 | −2.227 | 1.168 | 0.966 | −2.239 | 1.142 | 1.000 |
| −2.150 | 0.805 | 0.931 | −2.223 | 0.993 | 0.966 | −2.149 | 0.999 | 1.000 |
| −1.977 | 0.756 | 0.931 | −2.111 | 0.878 | 0.966 | −1.953 | 0.955 | 1.000 |
| −1.741 | 0.793 | 0.931 | −1.906 | 0.857 | 0.966 | −1.953 | 1.636 | 1.000 |
| −1.938 | 1.501 | 0.931 | −1.738 | 1.722 | 0.966 | −2.181 | 1.377 | 1.000 |
| −2.173 | 1.201 | 0.931 | −2.063 | 1.445 | 0.966 | −2.242 | 1.177 | 1.000 |
| −2.235 | 0.982 | 0.931 | −2.212 | 1.212 | 0.966 | −2.176 | 1.020 | 1.000 |
| −2.175 | 0.826 | 0.931 | −2.233 | 1.026 | 0.966 | −2.014 | 0.958 | 1.000 |
| −2.023 | 0.758 | 0.931 | −2.141 | 0.893 | 0.966 | −1.701 | 0.982 | 1.000 |
| −1.788 | 0.782 | 0.931 | −1.959 | 0.853 | 0.966 | −1.501 | 1.891 | 1.000 |
| −1.874 | 1.559 | 0.931 | −1.690 | 0.894 | 0.966 | −1.357 | 1.014 | 1.000 |
| −2.143 | 1.253 | 0.931 | −1.666 | 1.765 | 0.966 | −1.421 | 1.914 | 1.000 |
| −1.566 | 0.838 | 0.931 | −1.357 | 0.952 | 0.966 | −1.451 | 1.010 | 1.000 |
| −1.157 | 0.910 | 0.931 | −1.199 | 1.920 | 0.966 | −1.341 | 1.932 | 1.000 |
| −1.646 | 0.817 | 0.931 | −1.592 | 1.804 | 0.966 | −1.544 | 1.002 | 1.000 |
| −1.241 | 0.904 | 0.931 | −1.451 | 0.939 | 0.966 | −1.251 | 1.945 | 1.000 |
| −1.361 | 1.853 | 0.931 | −1.515 | 1.838 | 0.966 | −1.655 | 1.829 | 1.000 |
| −1.323 | 0.893 | 0.931 | −1.544 | 0.923 | 0.966 | −1.637 | 0.991 | 1.000 |
| −1.405 | 0.877 | 0.931 | −1.437 | 1.867 | 0.966 | −1.171 | 1.003 | 1.000 |
| −1.204 | 1.890 | 0.931 | −1.636 | 0.905 | 0.966 | −1.579 | 1.862 | 1.000 |
| −1.594 | 1.754 | 0.931 | −1.169 | 0.959 | 0.966 | −1.264 | 1.012 | 1.000 |
| −1.486 | 0.859 | 0.931 | −1.356 | 1.891 | 0.966 | −0.219 | 1.538 | 1.000 |
| −1.519 | 1.792 | 0.931 | −1.263 | 0.959 | 0.966 | −0.890 | 0.932 | 1.000 |
| −0.281 | 1.613 | 0.931 | −0.060 | 1.391 | 0.966 | −0.571 | 1.799 | 1.000 |
| −0.735 | 0.849 | 0.931 | −0.428 | 1.716 | 0.966 | −0.442 | 0.679 | 1.000 |
| −1.043 | 1.904 | 0.931 | −0.897 | 0.919 | 0.966 | −0.982 | 1.940 | 1.000 |
| −0.342 | 0.629 | 0.931 | −0.507 | 0.740 | 0.966 | −0.045 | 0.309 | 1.000 |
| 0.005 | 0.307 | 0.931 | −0.090 | 0.386 | 0.966 | −0.143 | 1.464 | 1.000 |
| −0.198 | 1.543 | 0.931 | 0.011 | 1.310 | 0.966 | −0.987 | 0.964 | 1.000 |
| −0.568 | 1.796 | 0.931 | −0.359 | 1.667 | 0.966 | −0.499 | 1.757 | 1.000 |
| −0.819 | 0.875 | 0.931 | −0.981 | 0.939 | 0.966 | −0.530 | 0.743 | 1.000 |
| −0.419 | 0.685 | 0.931 | −0.726 | 1.867 | 0.966 | −0.893 | 1.923 | 1.000 |
| −0.060 | 0.376 | 0.931 | −0.581 | 0.785 | 0.966 | −0.119 | 0.387 | 1.000 |
| −0.119 | 1.468 | 0.931 | −0.168 | 0.463 | 0.966 | −0.071 | 1.386 | 1.000 |
| −0.904 | 0.894 | 0.931 | −0.292 | 1.615 | 0.966 | −1.078 | 0.986 | 1.000 |
| −0.882 | 1.893 | 0.931 | −1.075 | 0.953 | 0.966 | −0.430 | 1.711 | 1.000 |
| −0.499 | 0.736 | 0.931 | −0.648 | 1.837 | 0.966 | −0.616 | 0.798 | 1.000 |
| −0.127 | 0.443 | 0.931 | −0.656 | 0.826 | 0.966 | −0.806 | 1.900 | 1.000 |
| −0.043 | 1.390 | 0.931 | −1.039 | 1.926 | 0.966 | −0.195 | 0.464 | 1.000 |
| −0.419 | 1.713 | 0.931 | −0.248 | 0.538 | 0.966 | −0.001 | 1.306 | 1.000 |
| −0.990 | 0.906 | 0.931 | −0.211 | 1.544 | 0.966 | −0.363 | 1.662 | 1.000 |
| −0.575 | 0.778 | 0.931 | −0.572 | 1.801 | 0.966 | −0.704 | 0.849 | 1.000 |
| −0.196 | 0.507 | 0.931 | −0.734 | 0.863 | 0.966 | −0.721 | 1.870 | 1.000 |
| 0.029 | 1.309 | 0.931 | −0.331 | 0.610 | 0.966 | −0.275 | 0.539 | 1.000 |
| −0.349 | 1.665 | 0.931 | −0.134 | 1.469 | 0.966 | 0.066 | 1.223 | 1.000 |
| −1.074 | 0.911 | 0.931 | −0.499 | 1.761 | 0.966 | −0.298 | 1.609 | 1.000 |
| −0.725 | 1.858 | 0.931 | −0.815 | 0.894 | 0.966 | −0.795 | 0.893 | 1.000 |
| −0.654 | 0.816 | 0.931 | −0.881 | 1.908 | 0.966 | −0.645 | 1.837 | 1.000 |
| −0.268 | 0.570 | 0.931 | −0.417 | 0.677 | 0.966 | −0.357 | 0.610 | 1.000 |
| 1.080 | −0.426 | 0.931 | −0.016 | 0.306 | 0.966 | −1.071 | 1.949 | 1.000 |
| 0.547 | 0.572 | 0.931 | 1.139 | −1.403 | 0.966 | 0.066 | 0.181 | 1.000 |
| 0.098 | 1.227 | 0.931 | 0.813 | 0.050 | 0.966 | 0.639 | −0.612 | 1.000 |
| 0.461 | −0.274 | 0.931 | 0.340 | 0.865 | 0.966 | 1.122 | −0.636 | 1.000 |
| 1.046 | −1.199 | 0.931 | 0.433 | −0.268 | 0.966 | 0.582 | 0.431 | 1.000 |
| 0.634 | 0.423 | 0.931 | 1.011 | −1.183 | 0.966 | 0.130 | 1.139 | 1.000 |
| 0.165 | 1.142 | 0.931 | 0.931 | −0.181 | 0.966 | 0.521 | −0.433 | 1.000 |
| 0.333 | −0.096 | 0.931 | 0.432 | 0.722 | 0.966 | 1.076 | −1.335 | 1.000 |
| 0.934 | −1.011 | 0.931 | 0.306 | −0.092 | 0.966 | 0.663 | 0.283 | 1.000 |
| 0.719 | 0.273 | 0.931 | 0.900 | −0.997 | 0.966 | 0.228 | 1.002 | 1.000 |
| 0.266 | 1.004 | 0.931 | 1.046 | −0.415 | 0.966 | 0.400 | −0.257 | 1.000 |
| 0.255 | 0.008 | 0.931 | 0.520 | 0.576 | 0.966 | 0.974 | −1.160 | 1.000 |
| 0.819 | −0.825 | 0.931 | 0.079 | 1.228 | 0.966 | 0.784 | 0.057 | 1.000 |
| 0.844 | 0.042 | 0.931 | 0.204 | 0.044 | 0.966 | 0.322 | 0.863 | 1.000 |
| 0.363 | 0.863 | 0.931 | 0.787 | −0.812 | 0.966 | 0.275 | −0.083 | 1.000 |
| 0.175 | 0.110 | 0.931 | 0.606 | 0.428 | 0.966 | 0.865 | −0.976 | 1.000 |
| 0.703 | −0.639 | 0.931 | 0.145 | 1.143 | 0.966 | 0.901 | −0.172 | 1.000 |
| 0.964 | −0.191 | 0.931 | 0.096 | 0.177 | 0.966 | 0.411 | 0.721 | 1.000 |
| 0.456 | 0.718 | 0.931 | 0.672 | −0.629 | 0.966 | 0.172 | 0.051 | 1.000 |
| 0.091 | 0.210 | 0.931 | 0.690 | 0.280 | 0.966 | 0.753 | −0.794 | 1.000 |
| 0.584 | −0.456 | 0.931 | 0.245 | 1.006 | 0.966 | 1.013 | −0.404 | 1.000 |
| 1.714 | −1.889 | 0.931 | 0.554 | −0.447 | 0.966 | 0.498 | 0.576 | 1.000 |
| 1.617 | −1.644 | 0.931 | 1.546 | −2.090 | 0.966 | 1.503 | −2.059 | 1.000 |
| 1.558 | −2.086 | 0.931 | 1.715 | −1.975 | 0.966 | 1.176 | −1.510 | 1.000 |

TABLE I-continued

| X | Y | Z' | X | Y | Z' | X | Y | Z' |
|---|---|---|---|---|---|---|---|---|
| 1.677 | −2.132 | 0.931 | 1.634 | −1.767 | 0.966 | 1.616 | −2.064 | 1.000 |
| 1.758 | −2.048 | 0.931 | 1.367 | −1.121 | 0.966 | 1.677 | −1.976 | 1.000 |
| 1.732 | −1.940 | 0.931 | 1.680 | −2.080 | 0.966 | 1.631 | −1.836 | 1.000 |
| 1.637 | −1.693 | 0.931 | 1.719 | −1.990 | 0.966 | 1.613 | −1.788 | 1.000 |
| 1.193 | −0.664 | 0.931 | 1.530 | −2.077 | 0.966 | 1.487 | −2.045 | 1.000 |
| 1.587 | −2.118 | 0.931 | 1.635 | −2.105 | 0.966 | 1.593 | −2.074 | 1.000 |
| 1.650 | −2.136 | 0.931 | 1.653 | −1.815 | 0.966 | 1.674 | −1.992 | 1.000 |
| 1.752 | −2.064 | 0.931 | 1.468 | −1.356 | 0.966 | 1.649 | −1.886 | 1.000 |
| 1.750 | −1.987 | 0.931 | 1.710 | −2.037 | 0.966 | 1.228 | −0.871 | 1.000 |
| 1.656 | −1.742 | 0.931 | 1.516 | −2.059 | 0.966 | 1.575 | −1.692 | 1.000 |
| 1.302 | −0.903 | 0.931 | 1.609 | −2.108 | 0.966 | 1.567 | −2.077 | 1.000 |
| 1.624 | −2.134 | 0.931 | 1.672 | −1.864 | 0.966 | 1.474 | −2.028 | 1.000 |
| 1.739 | −2.088 | 0.931 | 1.577 | −1.621 | 0.966 | 1.667 | −2.007 | 1.000 |
| 1.757 | −2.002 | 0.931 | 1.659 | −2.095 | 0.966 | 1.667 | −1.932 | 1.000 |
| 1.431 | −1.868 | 0.931 | 1.720 | −2.005 | 0.966 | 1.330 | −1.102 | 1.000 |
| 1.675 | −1.791 | 0.931 | 1.583 | −2.106 | 0.966 | 1.541 | −2.075 | 1.000 |
| 1.406 | −1.139 | 0.931 | 1.390 | −1.844 | 0.966 | 1.374 | −1.858 | 1.000 |
| 1.572 | −2.104 | 0.931 | 1.691 | −1.914 | 0.966 | 1.654 | −2.031 | 1.000 |
| 1.722 | −2.108 | 0.931 | 1.596 | −1.670 | 0.966 | 1.673 | −1.946 | 1.000 |
| 1.761 | −2.016 | 0.931 | 1.157 | −0.650 | 0.966 | 1.429 | −1.335 | 1.000 |
| 1.304 | −1.646 | 0.931 | 1.696 | −2.061 | 0.966 | 1.594 | −1.740 | 1.000 |
| 1.695 | −1.840 | 0.931 | 1.563 | −2.100 | 0.966 | 1.521 | −2.069 | 1.000 |
| 1.507 | −1.377 | 0.931 | 1.265 | −1.624 | 0.966 | 1.275 | −1.685 | 1.000 |
| 1.605 | −2.128 | 0.931 | 1.708 | −1.961 | 0.966 | 1.637 | −2.050 | 1.000 |
| 1.701 | −2.123 | 0.931 | 1.615 | −1.718 | 0.966 | 1.677 | −1.961 | 1.000 |
| 1.761 | −2.032 | 0.931 | 1.264 | −0.887 | 0.966 | 1.537 | −1.597 | 1.000 |
| 1.176 | −1.422 | 0.931 | 1.716 | −2.021 | 0.966 | 1.556 | −1.645 | 1.000 |

It will also be appreciated that the airfoil disclosed in the above table may be scaled up or down geometrically for use in other similar turbine designs. Consequently, the coordinate values set forth in Table I may be scaled upwardly or downwardly such that the airfoil section shape remains unchanged. A scaled version of the coordinates in Table I would be represented by X, Y and, optionally, Z coordinate values (after the Z values have been converted to inches) multiplied or divided by the same constant or number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket having a bucket airfoil shape in an envelope within ±0.160 inches in a direction normal to any airfoil surface location wherein the airfoil has a nominal profile substantially in accordance with Cartesian coordinate values of X, Y and Z set forth in Table I wherein Z is a non-dimensional value along a bucket centerline coincident with a radius from a turbine axis of rotation convertible to a Z distance in inches from said turbine axis by multiplying the Z value by a height of the airfoil and adding that product to a root radius of the bucket and wherein X and Y are distances in inches defining the airfoil profile at each distance Z, the profiles at the Z distances being joined smoothly with one another to form a complete airfoil shape.

2. A turbine bucket according to claim 1 forming part of a first stage of a turbine.

3. A turbine bucket according to claim 1 wherein the Z value is measured from an intersection of the bucket centerline along a radius from the turbine axis and the root radius of a flowpath through the turbine.

4. A turbine bucket according to claim 1 wherein the root radius of the airfoil is 49.400 inches and a height of the airfoil bucket from the root radius is 6.815 inches, said bucket comprising part of a first stage of a turbine.

5. A turbine bucket having an uncoated nominal airfoil profile substantially in accordance with Cartesian coordinate values of X, Y and Z set forth in Table I wherein Z is a non-dimensional value along a bucket centerline coincident with a radius from a turbine axis of rotation convertible to a Z distance in inches from said turbine axis by multiplying the Z value by a height of the airfoil and adding that product to a root radius of the bucket and wherein X and Y are distances in inches defining the airfoil profile at each distance Z, the profiles at the Z distances being joined smoothly with one another to form a complete airfoil shape, the X and Y distances being scalable as a function of the same constant or number to provide a scaled-up or scaled-down bucket airfoil.

6. A turbine bucket according to claim 5 forming part of a first stage of a turbine.

7. A turbine bucket according to claim 5 wherein the root radius of the airfoil is 49.400 inches and a height of the airfoil bucket from the root radius is 6.815 inches, said bucket comprising part of a first stage of a turbine.

8. A turbine comprising a turbine wheel having a plurality of buckets, each of said buckets having an airfoil shape in an envelope within ±0.160 inches in a direction normal to any airfoil surface location wherein the airfoil has a nominal profile substantially in accordance with Cartesian coordinate values of X, Y and Z set forth in Table I wherein Z is a non-dimensional value along a bucket centerline coincident with a radius from a turbine axis of rotation convertible to a Z distance in inches from said turbine axis by multiplying the Z value by a height of the airfoil and adding that product to a root radius of the bucket and wherein X and Y are distances in inches defining the airfoil profile at each distance Z, the profiles at the Z distances being joined smoothly with one another to form a complete airfoil shape.

9. A turbine according to claim 8 wherein the turbine wheel comprises a first stage turbine.

10. A turbine according to claim 8 wherein the turbine wheel has 92 buckets and Y represents a distance parallel to the turbine axis of rotation.

11. A turbine bucket according to claim 8 wherein each of the airfoil buckets has a root radius of 49.400 inches and a height from the root radius of 6.815 inches, said turbine wheel comprising a first stage of the turbine.

12. A turbine comprising a turbine wheel having a plurality of buckets, each of said buckets having an uncoated nominal airfoil profile substantially in accordance with Cartesian coordinate values of X, Y and Z set forth in Table I wherein Z is a non-dimensional value along a bucket centerline coincident with a radius from a turbine axis of rotation convertible to a Z distance in inches from said turbine axis of rotation by multiplying the Z value by a height of the airfoil and adding that product to a root radius of the bucket and wherein X and Y are distances in inches defining the airfoil profile at each distance Z, the profiles at the Z distances being joined smoothly with one another to form a complete airfoil shape, the X and Y distances being scalable as a function of the same constant or number to provide a scaled-up or scaled-down bucket airfoil.

13. A turbine according to claim 12 wherein the turbine wheel comprises a first stage of the turbine.

14. A turbine according to claim 12 wherein the turbine wheel has 92 buckets and Y represents a distance parallel to the turbine axis of rotation.

15. A turbine bucket according to claim 12 wherein each of the airfoil buckets has a root radius of 49.400 inches and a height from the root radius of 6.815 inches, said turbine wheel comprising a first stage of the turbine.

* * * * *

UNITED STATES PATENT AND TRADEMARK OFFICE

CERTIFICATE OF CORRECTION

PATENT NO. : 6,715,990 B1
DATED : April 6, 2004
INVENTOR(S) : Arness et al.

It is certified that error appears in the above-identified patent and that said Letters Patent is hereby corrected as shown below:

Column 4,
Line 8, delete "The z" and insert -- The Z --.

Column 11,
Third column of X coordinates, 5th line from bottom, delete "8.259" and insert -- 0.259 --.

Column 27,
second column of X coordinates, 12th line from top, delete "1.406" and insert -- -1.406 --.

Signed and Sealed this

Twenty-second Day of June, 2004

JON W. DUDAS
*Acting Director of the United States Patent and Trademark Office*